US008613488B2

(12) United States Patent
Tomoguchi et al.

(10) Patent No.: US 8,613,488 B2
(45) Date of Patent: Dec. 24, 2013

(54) INK CARTRIDGE, RECORDING DEVICE, AND METHOD FOR CONTROLLING RECORDING DEVICE

(75) Inventors: Suguru Tomoguchi, Nagoya (JP); Noritsugu Ito, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 400 days.

(21) Appl. No.: 13/016,854

(22) Filed: Jan. 28, 2011

(65) Prior Publication Data

US 2011/0187772 A1 Aug. 4, 2011

(30) Foreign Application Priority Data

Jan. 29, 2010 (JP) ..... 2010-019332

(51) Int. Cl.
*B41J 2/195* (2006.01)
*B41J 29/393* (2006.01)

(52) U.S. Cl.
USPC ..... 347/7; 347/19

(58) Field of Classification Search
USPC ..... 347/7
See application file for complete search history.

(56) References Cited

U.S. PATENT DOCUMENTS 4,476,472 A 10/1984 Aiba et al.
5,929,884 A 7/1999 Hetzer et al.
5,963,237 A 10/1999 Ikkatai et al.
5,988,802 A 11/1999 Pawlowski, Jr. et al.
6,022,102 A 2/2000 Ikkatai et al.
6,161,920 A 12/2000 Santhanam et al.
6,164,743 A 12/2000 Hmelar et al.
6,293,662 B1 9/2001 Shihoh et al.
6,332,676 B1 12/2001 Santhanam
6,378,971 B1 4/2002 Tamura et al.
RE37,874 E 10/2002 Pawlowski, Jr. et al.
6,457,805 B2 * 10/2002 Ohtani et al. ..... 347/37
6,767,075 B1 7/2004 Takada et al.
2001/0024225 A1 9/2001 Ishizawa et al.

(Continued)

FOREIGN PATENT DOCUMENTS

EP 0799703 A2 10/1997
EP 0803364 A2 10/1997

(Continued)

OTHER PUBLICATIONS

Japan Patent Office, International Search Report for International Patent Application No. PCT/JP2011/052304 (counterpart International patent application), mailed Apr. 5, 2011.

(Continued)

*Primary Examiner* — Uyen Chau N Le
*Assistant Examiner* — Kajli Prince
(74) *Attorney, Agent, or Firm* — Baker Botts L.L.P.

(57) ABSTRACT

An ink cartridge includes: an ink accommodating unit; and a storing unit. The ink accommodating unit is configured to accommodate ink therein. The storing unit is configured to store time length data indicative of a length of time to be taken by the ink cartridge to move from a first position to a second position different from the first position, the first position and the second position being defined within a mounting unit in a recording device, the ink cartridge reaching the first position before reaching the second position when the ink cartridge is mounted in the mounting unit.

17 Claims, 14 Drawing Sheets

(56) References Cited

U.S. PATENT DOCUMENTS

| | | | |
|---|---|---|---|
| 2002/0024543 | A1 | 2/2002 | Kimura et al. |
| 2002/0089576 | A1 | 7/2002 | Ishizawa et al. |
| 2002/0196317 | A1 | 12/2002 | Santhanam et al. |
| 2003/0071874 | A1 | 4/2003 | Ishizawa et al. |
| 2004/0201652 | A1 | 10/2004 | Katayama |
| 2004/0252146 | A1 | 12/2004 | Naka et al. |
| 2005/0068382 | A1 | 3/2005 | Kimura et al. |
| 2005/0134663 | A1 | 6/2005 | Sasaki et al. |
| 2005/0146577 | A1 | 7/2005 | Sasaki et al. |
| 2005/0146578 | A1 | 7/2005 | Takagi et al. |
| 2005/0146579 | A1 | 7/2005 | Sasaki et al. |
| 2005/0151812 | A1 | 7/2005 | Sasaki et al. |
| 2005/0195225 | A1 | 9/2005 | Takagi et al. |
| 2005/0212874 | A1 | 9/2005 | Nomura et al. |
| 2006/0007283 | A1 | 1/2006 | Sacco, Jr. et al. |
| 2007/0008368 | A1 | 1/2007 | Maru et al. |
| 2007/0222829 | A1 | 9/2007 | Stathem |
| 2007/0229618 | A1 | 10/2007 | Sugahara |
| 2008/0231676 | A1 | 9/2008 | Shimizu |
| 2008/0259145 | A1 | 10/2008 | Nomura et al. |
| 2008/0273048 | A1 | 11/2008 | Naka et al. |
| 2008/0303879 | A1 | 12/2008 | Nip |
| 2009/0085942 | A1 | 4/2009 | Asauchi |
| 2009/0096849 | A1 | 4/2009 | Kanbe et al. |
| 2009/0141106 | A1 | 6/2009 | Takagi |
| 2009/0237426 | A1 | 9/2009 | Kimura |
| 2009/0244166 | A1 | 10/2009 | Sugahara |
| 2010/0079513 | A1 | 4/2010 | Taira et al. |
| 2010/0155417 | A1 | 6/2010 | Utzui et al. |
| 2010/0220127 | A1 | 9/2010 | Levy et al. |
| 2010/0238241 | A1 | 9/2010 | Sasaki |
| 2011/0000935 | A1 | 1/2011 | Iwamuro et al. |
| 2011/0141167 | A1 | 6/2011 | Kikkawa et al. |
| 2011/0242233 | A1 | 10/2011 | Hirano et al. |
| 2011/0249065 | A1 | 10/2011 | Hirano et al. |
| 2012/0069068 | A1 | 3/2012 | Ito et al. |
| 2012/0075392 | A1 | 3/2012 | Shirono et al. |
| 2013/0027480 | A1 | 1/2013 | Otobe |

FOREIGN PATENT DOCUMENTS

| | | | |
|---|---|---|---|
| EP | 0826505 | A2 | 3/1998 |
| EP | 1053881 | A1 | 11/2000 |
| EP | 1060895 | A1 | 12/2000 |
| EP | 1114725 | A2 | 7/2001 |
| EP | 1153752 | A2 | 11/2001 |
| EP | 1164025 | A1 | 12/2001 |
| EP | 1241011 | A2 | 9/2002 |
| EP | 1285764 | A1 | 2/2003 |
| EP | 1462263 | A2 | 9/2004 |
| EP | 1466739 | A1 | 10/2004 |
| EP | 1609604 | A1 | 12/2005 |
| EP | 1839876 | A1 | 10/2007 |
| EP | 2095961 | A1 | 9/2009 |
| EP | 2105306 | A2 | 9/2009 |
| EP | 2202078 | A1 | 6/2010 |
| EP | 2272675 | A2 | 1/2011 |
| GB | 2312283 | A | 10/1997 |
| JP | S60-092861 | A | 5/1985 |
| JP | H08-080618 | A | 3/1996 |
| JP | H11-286123 | A | 10/1999 |
| JP | 2005-238815 | A | 9/2005 |
| JP | 2005-306005 | A | 11/2005 |
| JP | 2010-017926 | A | 1/2010 |
| JP | 2010-069807 | A | 4/2010 |
| JP | 2010-076301 | A | 4/2010 |
| WO | 2005/075204 | A1 | 8/2005 |
| WO | 2008-117882 | A1 | 10/2008 |

OTHER PUBLICATIONS

European Patent Office, extended European Search Report for European Patent Application No. 11152591.1 (counterpart European patent application), dated Jun. 30, 2011.

European Patent Office, extended European Search Report for European Patent Application No. 11152604.2 (counterpart European patent application), dated Mar. 4, 2011.

European Patent Office, partial European Search Report for European Patent Application No. 11152591.1 (counterpart European patent application), dated Mar. 4, 2011.

United States Patent and Trademark Office, Non-Final Office Action for U.S. Appl. No. 13/016,615 (related U.S. patent application), mailed Dec. 21, 2012.

United States Patent and Trademark Office, Office Action for U.S. Appl. No. 13/016,615 (counterpart U.S. patent application), mailed Feb. 14, 2013.

Japan Patent Office, International Search Report in counterpart Patent Application No. PCT/JP2011/052305, mailed Apr. 5, 2011.

Japan Patent Office, Written Opinion of the International Searching Authority in counterpart Patent Application No. PCT/JP2011/052305, mailed Apr. 5, 2011.

United States Patent and Trademark Office, Office Action for U.S. Appl. No. 13/016,860 (related U.S. patent application), mailed Apr. 1, 2013.

European Patent Office, Partial European Search Report for European Patent Application No. 11152574.7 (counterpart to above-captioned patent application), dated Mar. 1, 2011.

European Patent Office, extended European Search Report for European Patent Application No. 11152574.7 (counterpart to above-captioned patent application), dated Jun. 29, 2011.

The International Bureau of WIPO, International Preliminary Report on Patentability for International Patent Application No. PCT/JP2011/052305 (counterpart PCT patent application), mailed Aug. 9, 2012.

European Patent Office, Extended European Search Report for European Patent Application No. 11737231.8, mailed Oct. 7, 2013.

European Patent Office, Extended European Search Report for European Patent Application No. 11737232.6, mailed Oct. 7, 2013.

* cited by examiner

INK CARTRIDGE, RECORDING DEVICE, AND METHOD FOR CONTROLLING RECORDING DEVICE

CROSS REFERENCE TO RELATED APPLICATION

This application claims priority from Japanese Patent Application No. 2010-019332 filed Jan. 29, 2010. The entire content of each of these priority applications is incorporated herein by reference.

TECHNICAL FIELD

The present invention relates to an ink cartridge, a recording device, and a method for controlling a recording device.

BACKGROUND

A conventional ink cartridge houses an ink bag. A valve is attached to the ink bag for controlling the supply of ink to a recording device. When the user mounts the ink cartridge into the recording device, an ink supply needle provided in the recording device opens the ink bag valve, allowing ink in the ink bag to be supplied to the recording device through the ink supply needle.

There is another conventional inkjet printer, in which a subsidiary tank is provided between a main tank and an inkjet head. The subsidiary tank is for separating air from ink and for generating a desired pressure head difference between the inkjet head and the subsidiary tank.

SUMMARY

However, if the user mounts the conventional ink cartridge into a recording device quickly or abruptly, there occurs a sudden deceleration in the ink cartridge from a point during the mounting motion (while the ink cartridge is moving at a high velocity) to the point that mounting is completed (when the ink cartridge has come to a halt). Such a great deceleration of the ink cartridge applies a large force to the ink accommodated in the ink bag, producing a large change in ink pressure. This change in pressure is transmitted to the recording head, breaking the meniscus formed in nozzles formed in the recording head and, hence, allowing ink to leak from the nozzles. If printing is resumed in this state, the recording head may not attain desired ink ejection characteristics.

In addition, if the subsidiary tank is provided between the inkjet print head and an ink cartridge, such a great deceleration of the ink cartridge may cause ink to flow from the ink cartridge into the subsidiary tank. The height of the liquid surface of the ink in the subsidiary tank may change and the pressure head difference between the subsidiary tank and the inkjet head will go beyond a desirable range. The negative pressure applied to ink within the nozzles will go beyond a desirable range. If printing is resumed in this state, the recording head may not attain desired ink ejection characteristics.

In view of the foregoing, it is an object of the present invention to provide an ink cartridge, a recording device, and a method for controlling a recording device, which are capable of maintaining desirable ink ejection characteristics.

In order to attain the above and other objects, the present invention provides an ink cartridge, including: an ink accommodating unit; and a storing unit. The ink accommodating unit is configured to accommodate ink therein. The storing unit is configured to store time length data indicative of a length of time to be taken by the ink cartridge to move from a first position to a second position different from the first position, the first position and the second position being defined within a mounting unit in a recording device, the ink cartridge reaching the first position before reaching the second position when the ink cartridge is mounted in the mounting unit.

According to another aspect, the present invention provides a recording device, including: a recording head; an ink cartridge; a mounting unit; a storing unit; a first detecting unit; a second detecting unit; a calculating unit; a comparing unit; an ink discharging unit; and a control unit. The recording head is configured so as to eject ink therefrom. The ink cartridge has an ink accommodating unit that is configured to accommodate ink therein. The ink cartridge is mounted in the mounting unit. The storing unit is configured to store time length data indicative of a length of time to be taken by the ink cartridge to move from a first position to a second position different from the first position, the first position and the second position being defined within the mounting unit, the ink cartridge reaching the first position before reaching the second position when the ink cartridge is mounted in the mounting unit. The first detecting unit is configured to output a first detection signal upon detecting that the ink cartridge is located at the first position. The second detecting unit is configured to output a second detection signal upon detecting that the ink cartridge is located at the second position. The calculating unit calculates a length of time taken by the ink cartridge to move from the first position to the second position based on the first detection signal and the second detection signal. The comparing unit compares the calculated length of time with the length of time indicated by the time length data. The ink discharging unit is configured to forcibly eject ink from the recording head. The control unit controls the ink discharging unit based on a comparing result by the comparing unit.

According to another aspect, the present invention provides a method for controlling a recording device, the recording device including: a recording head that is configured so as to eject ink therefrom; an ink cartridge that has an ink accommodating unit that is configured to accommodate ink therein; a mounting unit, in which the ink cartridge is mounted; a storing unit that is configured to store time length data indicative of a length of time to be taken by the ink cartridge to move from a first position to a second position different from the first position, the first position and the second position being defined within the mounting unit, the ink cartridge reaching the first position before reaching the second position when the ink cartridge is mounted in the mounting unit; a first detecting unit that is configured to output a first detection signal upon detecting that the ink cartridge is located at the first position; a second detecting unit that is configured to output a second detection signal upon detecting that the ink cartridge is located at the second position; and an ink discharging unit that is configured to forcibly eject ink from the recording head. The method includes: calculating a length of time taken by the ink cartridge to move from the first position to the second position based on the first detection signal and the second detection signal; comparing the calculated length of time with the length of time indicated by the time length data; and controlling the ink discharging unit based on a comparing result by the comparing unit.

According to another aspect, the present invention provides an ink cartridge, including: a casing; an ink accommodating unit; a first moving body; a second moving body; a first detecting unit; a second detecting unit; and a storing unit. The ink accommodating unit is provided in the casing. The first moving body is provided in the casing and is movable relative to the casing. The second moving body is provided in the casing and is movable relative to the casing. The first detecting unit is configured to detect that the first moving body is located at a first relative position relative to the casing. The second detecting unit is configured to detect that the second moving body is located at a second relative position relative to the casing. The storing unit is configured to store time length data indicative of a length of time defined from when the first moving body reaches the first relative position and until when the second moving body reaches the second relative position.

According to another aspect, the present invention provides an ink cartridge, including: an ink accommodating unit; an ink delivery path; a first valve; a second valve; a first detecting unit; a second detecting unit; and a storing unit. The ink accommodating unit is configured to accommodate ink therein. The ink delivery path is in fluid communication with the ink accommodating unit at one end and has an ink delivery opening at another end. The first valve is provided in the another end of the ink delivery path and is configured so as to be capable of being switched between an opened state and a closed state. The second valve is provided in the ink delivery path between the one end and the another end and is configured so as to be capable of being switched between an opened state and a closed state. The first detecting unit is configured to detect whether the first valve is in the opened state or the closed state. The second detecting unit is configured to detect whether the first valve is in the opened state or the closed state. The storing unit is configured to store time length data indicative of a length of time defined from when the first valve is switched from the closed state to the opened state and until when the second valve is switched from the closed state to the opened state.

According to another aspect, the present invention provides an ink cartridge, including: an ink accommodating unit that is configured to accommodate ink therein; and a storing unit that is configured to store time length data indicative of a length of time to be taken by the ink cartridge to move for a predetermined distance.

BRIEF DESCRIPTION OF THE DRAWINGS

In the drawings:

FIG. 2(*b*) is a schematic diagram showing an ink supplying system of the inkjet printer in FIG. 1;

FIG. 7(*b*) is a partial cross-sectional view of the ink cartridge when the first and second valves are open;

DETAILED DESCRIPTION

Next, embodiments of the present invention will be described while referring to the accompanying drawings.

First Embodiment

Figure 1:
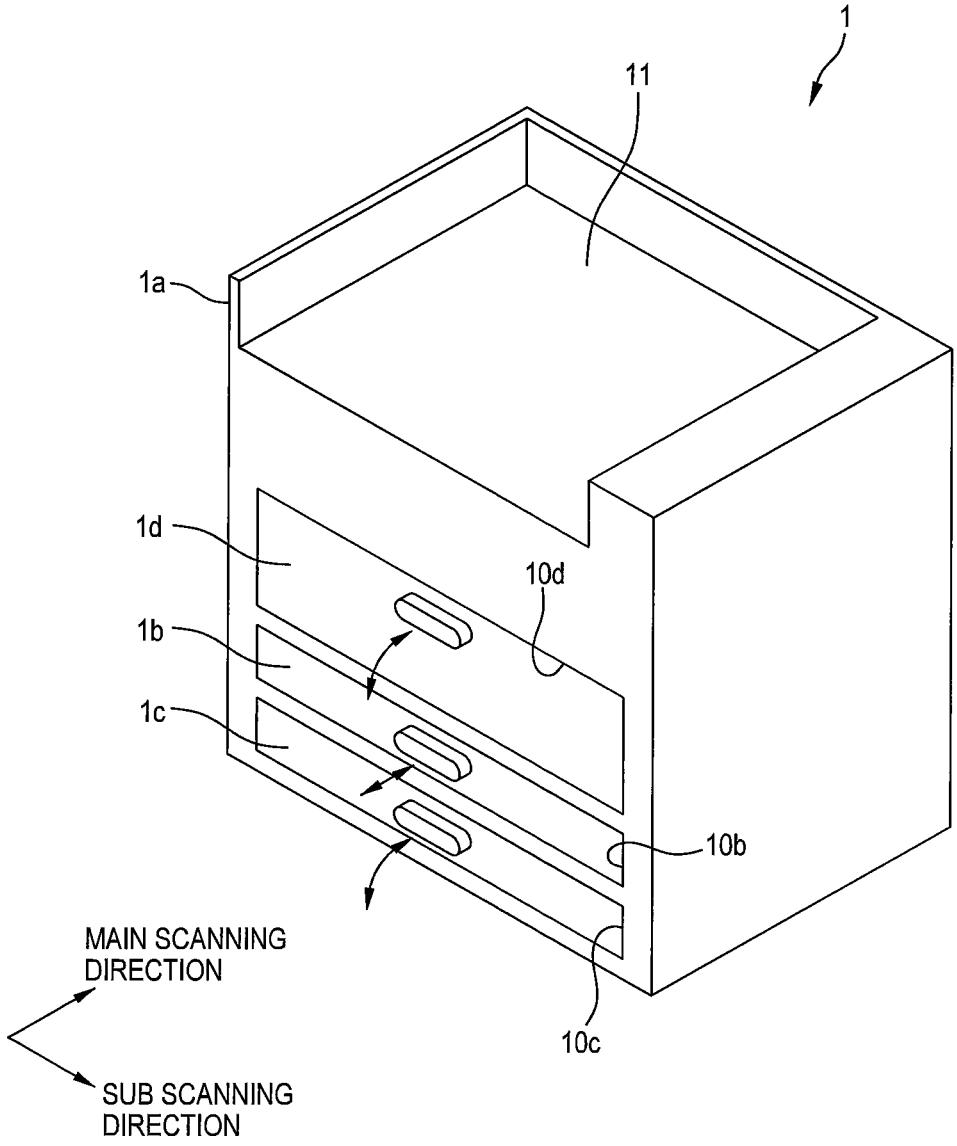
FIG. 1 is a perspective view showing the external appearance of an inkjet printer according to a first embodiment of the present invention.

In a first embodiment of the present invention, the recording device is an inkjet printer 1 (recording device). As shown in FIG. 1, the inkjet printer 1 has a casing 1*a* formed in the shape of a rectangular parallelepiped. Three openings 10*d*, 10*b*, and 10*c* are formed in order from top to bottom in the front surface of the casing 1*a* (the surface on the near side in FIG. 1). Doors 1*d* and 1*c* are disposed in the openings 10*d* and 10*c*, respectively, so as to be flush with the front surface of the casing 1*a*. The doors 1*d* and 1*c* can be opened and closed about a horizontal axis passing through their respective lower edges. A paper supply unit 1*b* is inserted into the opening 10*b*. A paper discharging unit 11 is provided on the top of the casing 1*a*. The door 1*d* is disposed on the same level vertically as a conveying unit 21 described later, facing the conveying unit 21 in a main scanning direction of the inkjet printer 1 (toward the far side in FIG. 1).

Figure 2A:
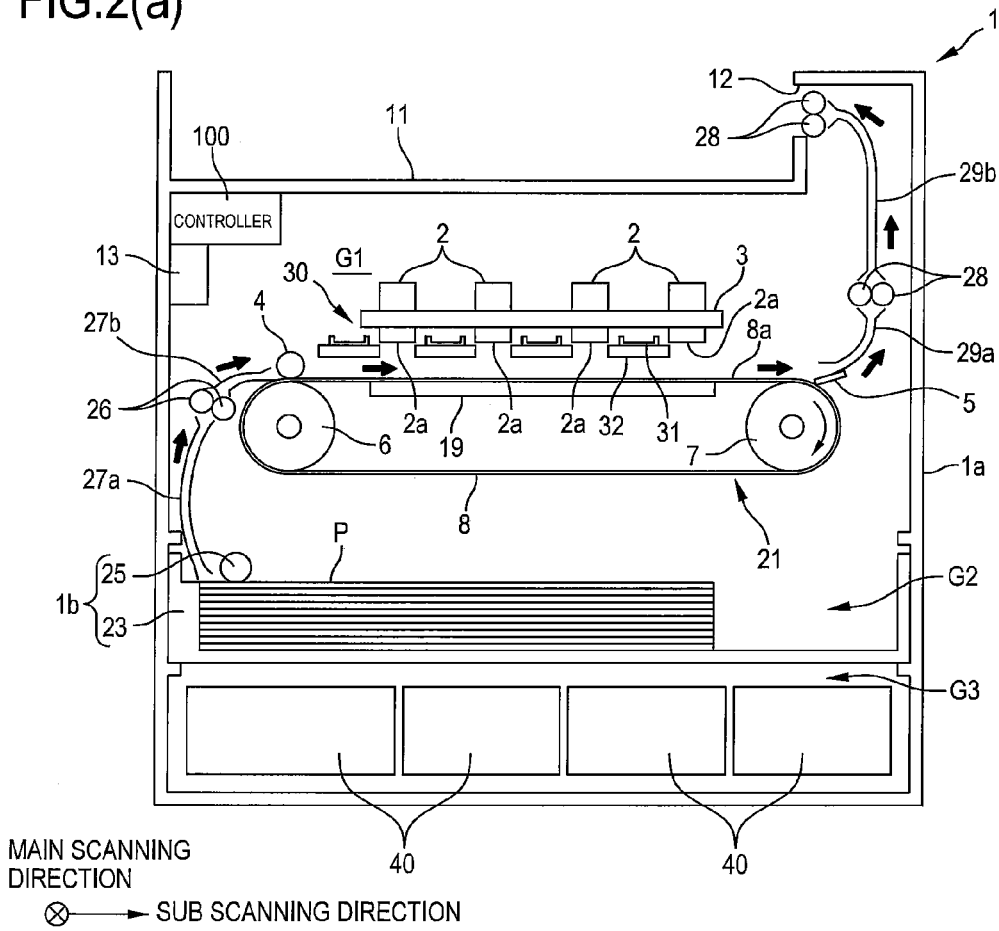
FIG. 2(*a*) is a side cross-sectional view showing the internal structure of the inkjet printer in FIG. 1, in which inkjet heads are in a printing position.
Figure 2B:
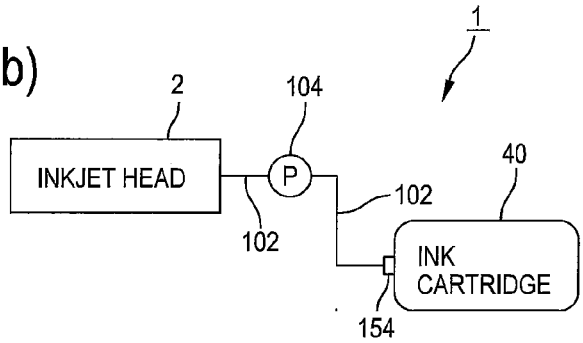

Next, the internal structure of the inkjet printer 1 will be described with reference to FIGS. 2(*a*) and 2(*b*). As shown in FIG. 2(*a*), the interior of the casing 1*a* is partitioned into three spaces G1-G3 in order from top to bottom. Within the space G1 are disposed four inkjet heads 2 (recording heads) that eject ink droplets in the respective colors magenta, cyan, yellow, and black; a maintenance unit 30 (ink discharging unit), and the conveying unit 21. The paper supply unit 1*b* is disposed in the space G2, and four ink cartridges 40 are disposed in the space G3.

The paper supply unit 1*b* and the four ink cartridges 40 are mounted in and removed from the casing 1*a* along the main scanning direction (the direction orthogonal to the surface of the paper in FIG. 2(*a*)). In the embodiment, a sub scanning direction is a direction in which a sheet P is conveyed by the conveying unit 21, while the main scanning direction is a horizontal direction orthogonal to the sub scanning direction. The inkjet printer 1 is further provided with a controller 100 that controls the paper supply unit 1*b*, maintenance unit 30, conveying unit 21, and inkjet heads 2.

The four inkjet heads 2 are supported in the casing 1*a* by means of a frame 3 and are juxtaposed in the sub scanning direction. Each inkjet head 2 is elongated in the main scanning direction. In other words, the inkjet printer 1 of the embodiment is a line-type color inkjet printer. An elevating mechanism (not shown) is also provided for moving the frame 3 vertically within the casing 1*a*. The controller 100 controls the elevating mechanism to move the inkjet heads 2 mounted in the frame 3 between a printing position (the position shown in FIG. 2(*a*)) and a retracted position (see FIG. 4(*a*)) higher than the printing position.

Each inkjet head 2 has a laminated body formed by bonding a channel unit and a plurality of actuators (both not shown in the drawings) together. The channel unit has a plurality of ink channels and a plurality of pressure chambers formed therein, and the actuators apply pressure to ink in the pressure chambers. The bottom surface of each inkjet head 2 is an ejection surface 2*a*. A plurality of ejection holes (not shown) for ejecting ink droplets from the plurality of pressure chambers are formed in each ejection surface 2*a*.

The bold arrows in FIG. 2(*a*) indicate a paper-conveying path formed in the inkjet printer 1 along which sheets P are conveyed from the paper supply unit 1*b* to the paper discharging unit 11. The paper supply unit 1*b* includes a paper tray 23 capable of accommodating a plurality of sheets P, and a feeding roller 25 mounted on the paper tray 23. When a drive force is applied to the feeding roller 25 by a feeding motor (not shown) controlled by the controller 100, the feeding roller 25 feeds the topmost sheet P accommodated in the paper tray 23. The sheet P fed by the feeding roller 25 is guided along guides 27*a* and 27*b*, and a pair of conveying rollers 26 grip and convey the sheet P to the conveying unit 21.

As shown in FIG. 2(*a*), the conveying unit 21 includes two belt rollers 6 and 7 and an endless conveying belt 8 looped around both belt rollers 6 and 7 and stretched taut therebetween. The belt roller 7 is a drive roller that is rotated clockwise in FIG. 2(*a*) when the controller 100 controls a conveying motor (not shown) to apply a drive force to a shaft of the belt roller 7. The belt roller 6 is a follow roller that also rotates clockwise in FIG. 2(*a*) when the conveying belt 8 is circulated by the rotating belt roller 7.

An outer surface 8*a* of the conveying belt 8 is coated with silicone to give the outer surface 8*a* tackiness. A nip roller 4 is disposed along the paper-conveying path at a position confronting the belt roller 6 through the conveying belt 8. The nip roller 4 holds the sheet P conveyed from the paper supply unit 1*b* against the outer surface 8*a* of the conveying belt 8. Once pressed against the outer surface 8*a*, the sheet P is conveyed rightward in FIG. 2(*a*) (in the paper-conveying direction) while being held on the outer surface 8*a* by the tacky coating.

A separating plate 5 is also disposed on the paper-conveying path at a position opposing the belt roller 7 through the conveying belt 8. The separating plate 5 functions to separate the sheet P from the outer surface 8*a* of the conveying belt 8. Once separated, the sheet P is guided toward pairs of conveying rollers 28 by guides 29*a* and 29*b*, and the conveying rollers 28 grip and discharge the sheet P onto the paper discharging unit 11 through an opening 12 formed in the top of the casing 1*a*. A feeding motor (not shown) controlled by the controller 100 applies a drive force to one of the conveying rollers 28 in each pair.

A platen 19 having a substantially rectangular parallelepiped shape is disposed within the loop of the conveying belt 8 at a position opposite the four inkjet heads 2. The top surface of the platen 19 contacts the inner surface of the conveying belt 8 on the upper portion of the loop and supports this upper loop portion from the inner surface of the conveying belt 8. Accordingly, the outer surface 8*a* on the upper loop portion of the conveying belt 8 is maintained parallel and opposite the ejection surfaces 2*a*, with a slight gap formed between the ejection surfaces 2*a* and the outer surface 8*a*. This gap constitutes part of the paper-conveying path. As a sheet P held on the outer surface 8*a* of the conveying belt 8 is conveyed directly beneath the four inkjet heads 2 in sequence, the inkjet heads 2 are controlled by the controller 100 to eject ink droplets of their respective colors onto the top surface of the sheet P, thereby forming a desired color image on the sheet P.

Of the four ink cartridges 40, the leftmost ink cartridge 40 shown in FIG. 2(*a*) stores black ink. As shown in FIG. 2(*a*), the leftmost ink cartridge 40 has a larger dimension in the sub scanning direction than the other three ink cartridges 40 and, hence, a greater ink capacity than the other three ink cartridges 40. The remaining three ink cartridges 40 possess an identical ink capacity and store ink in the colors magenta, cyan, and yellow, respectively.

To replace one of the ink cartridges 40, the operator opens the door 1*c* on the casing 1*a*, removes the ink cartridge 40 from the printer body, and mounts a new ink cartridge 40 in the printer body. Although the ink cartridges 40 are mounted individually in the printer body in the embodiment, the four ink cartridges 40 may instead be placed in a single cartridge tray to form an ink unit, and the entire ink unit can be mounted in the printer body.

Next will be described ink supplying systems provided in the inkjet printer 1. Four ink supplying systems are provided for the four inkjet print heads 2, respectively. The ink supplying systems have the same configurations with one another. One of the ink supplying systems will be described below while referring to FIG. 2(*b*), but the following description is in common to the other ink supplying systems.

As shown in FIG. 2(*b*), in each ink supplying system, one inkjet head 2 is connected via a flexible tube 102 (ink supplying path) to one ink supply channel 154 described later (see FIG. 9(*a*)). The ink channels formed in the inkjet head 2 are in fluid communication with the flexible tube 102. A pump 104 (ink discharging unit, ink forcibly supplying unit) is provided in the midway portion of the tube 102 connecting the inkjet head 2 and the ink supply channel 154. When one ink cartridge 40 is mounted in the body of the printer (the casing 1*a*), the ink cartridge 40 is connected to one ink supply channel 154 so that ink can be supplied from the ink cartridge 40 to the corresponding inkjet head 2. The pump 104 is controlled by the controller 100 to forcibly supply ink from the ink cartridge 40 to the inkjet head 2. This pump 104 is included in a maintenance unit 30 to be described later.

As shown in FIG. 2(*a*), the maintenance unit 30 is provided between the four inkjet heads 2 and the conveying unit 21. The maintenance unit 30 functions to resolve ejection failures in the inkjet heads 2. The maintenance unit 30 includes four plate-shaped members 32 disposed at equal intervals along the sub scanning direction, and four caps 31 fixed to respective plate-shaped members 32 and being capable of covering the ejection surfaces 2*a* of the respective inkjet heads 2.

Figure 3A:
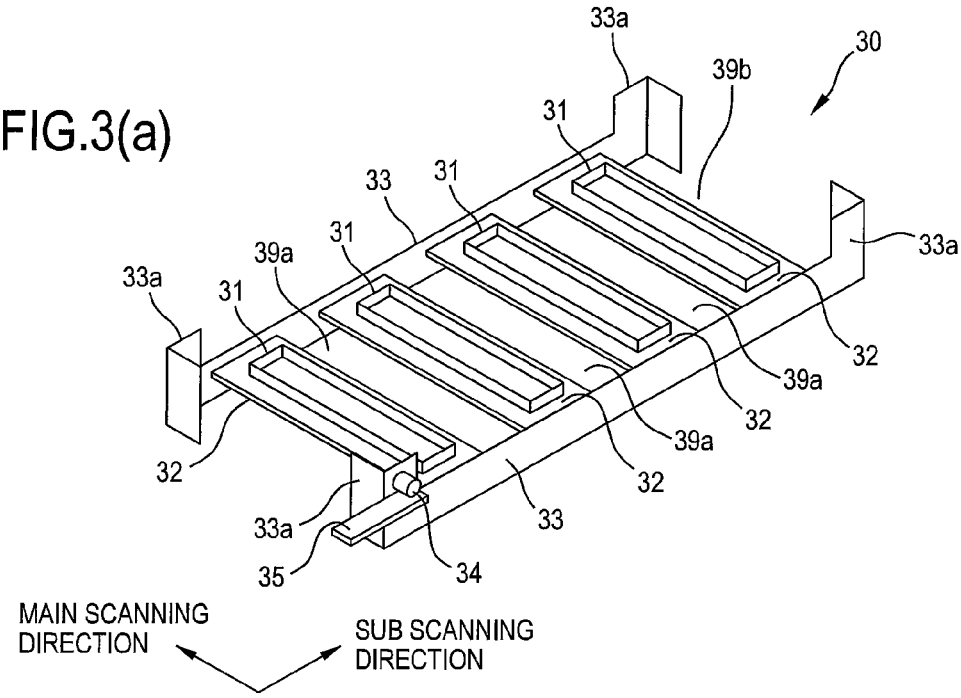
FIGS. 3(*a*) and 3(*b*) are perspective views of a maintenance unit, in which FIG. 3(*a*) shows the configuration of caps and an inner frame part of the maintenance unit, and FIG. 3(*b*) shows an outer frame of the maintenance unit.
Figure 3B:
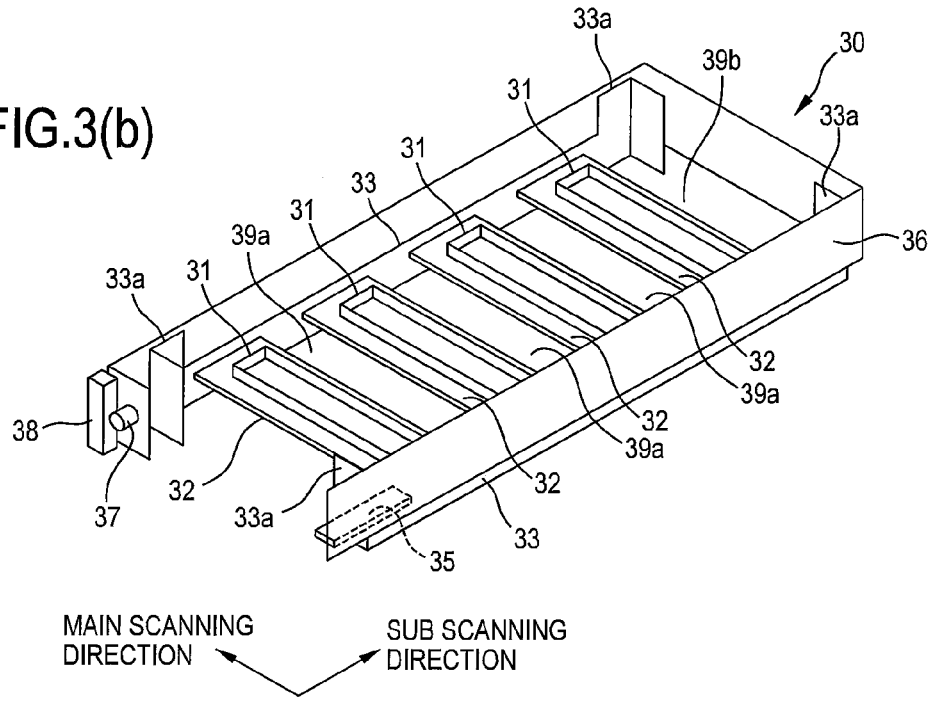

As shown in FIG. 3(*a*), the caps 31 are elongated in the main scanning direction, with their longitudinal dimension oriented parallel to the longitudinal dimension of the inkjet heads 2. The caps 31 are formed of an elastic material, such as rubber, and have a recessed part formed in the top thereof. In their initial state, the four caps 31 are disposed upstream of their corresponding inkjet heads 2 with respect to the paper-conveying direction. More specifically, the cap 31 positioned farthest upstream is disposed upstream of the inkjet head 2 positioned farthest upstream, and the remaining three caps 31 are disposed between adjacent pairs of inkjet heads 2. As the maintenance unit 30 is moved from this initial state, the four caps 31 move rightward and upward in FIG. 2(*a*) against the corresponding inkjet heads 2.

As shown in FIG. 3(*a*), the maintenance unit 30 also has a pair of inner frame parts 33 disposed one on either longitudinal end of the plate-shaped members 32. Each of the inner frame parts 33 has corner parts 33*a* protruding upward from both ends thereof. Pinion gears 34 fixed to the shaft of a drive motor (not shown) controlled by the controller 100 are provided respectively on one corner part 33*a* of each inner frame part 33 for engaging with respective rack gears 35 arranged horizontally. Note that only one of the pinion gears 34 (on the near-side inner frame part 33) is shown in FIG. 3(*a*).

As shown in FIG. 3(*b*), the maintenance unit 30 also has an outer frame 36 disposed around the pair of inner frame parts 33. The rack gears 35 shown in FIG. 3(*a*) (only one is shown in FIG. 3(*a*)) are fixed to the inside of the outer frame 36. In addition, a pinion gear 37 fixed to the shaft of a drive motor (not shown) controlled by the controller 100 is also provided on the outer frame 36 for engaging with a rack gear 38 arranged vertically. The rack gear 38 is provided on the inner surface of the casing 1*a*.

With this construction, the controller 100 can control the pair of inner frame parts 33 to move along the sub scanning direction by rotating the two pinion gears 34 in synchronization. The controller 100 can also control the outer frame 36 to move along the vertical by rotating the pinion gear 37.

More specifically, when the maintenance unit 30 is in its initial position shown in FIG. 2(*a*), three openings 39*a* between pairs of adjacent plate-shaped members 32 and an opening 39*b* between the plate-shaped member 32 positioned farthest downstream and the corner parts 33*a* on the downstream side respectively oppose the ejection surfaces 2*a*. When a capping operation for covering the ejection surfaces 2*a* with the caps 31 is initiated from this initial state, the elevating mechanism moves the inkjet heads 2 from the printing position to the retracted position, as illustrated in FIG. 4(*a*).

Figure 4A:
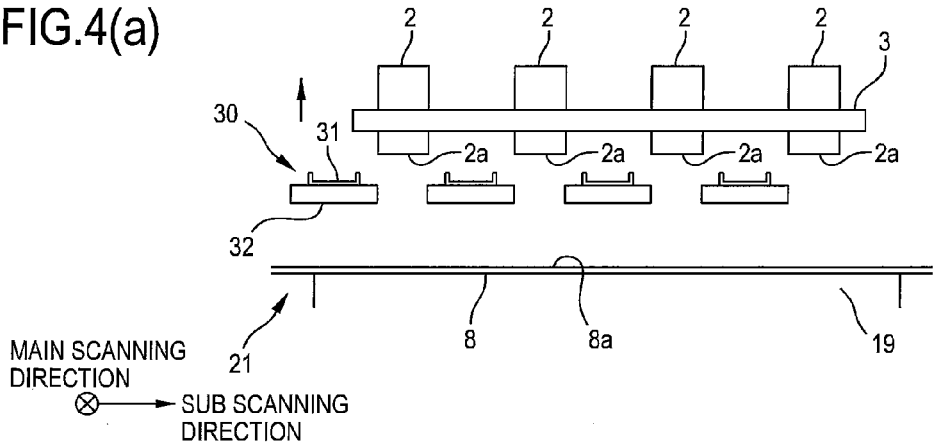
FIGS. 4(*a*)-4(*c*) are partial side views of the inkjet printer for illustrating a capping operation, wherein FIG. 4(*a*) shows the state where the inkjet heads are moved from a printing position to a retracted position, while caps are in an initial position, FIG. 4(*b*) shows the state where the caps are moved in a sub scanning direction to be in confrontation with ejection surfaces of the inkjet heads, and FIG. 4(*c*) shows the state where the caps are moved to a capping position covering the ejection surfaces of the inkjet heads.
Figure 4B:
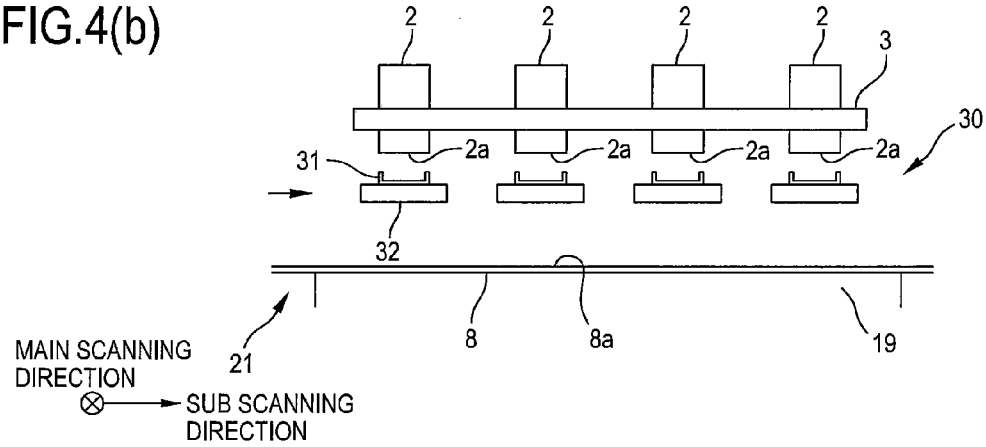
Figure 4C:
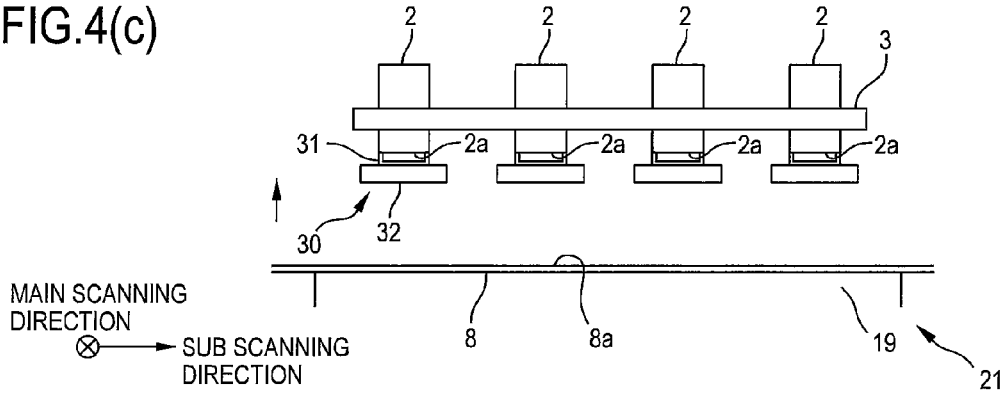

Next, the inner frame parts 33 are moved downstream in the paper-conveying direction until the caps 31 are positioned directly opposite the corresponding ejection surfaces 2*a*, as illustrated in FIG. 4(*b*). Next, the outer frame 36 is lifted vertically to a capping position in which the caps 31 are pressed against and cover the ejection surfaces 2*a*, as illustrated in FIG. 4(*c*). Through these steps, each of the caps 31 now covers a corresponding ejection surface 2*a*. When the steps are performed in reverse, the caps 31 can be returned to their initial position, and the inkjet heads 2 to the printing position.

Figure 5:
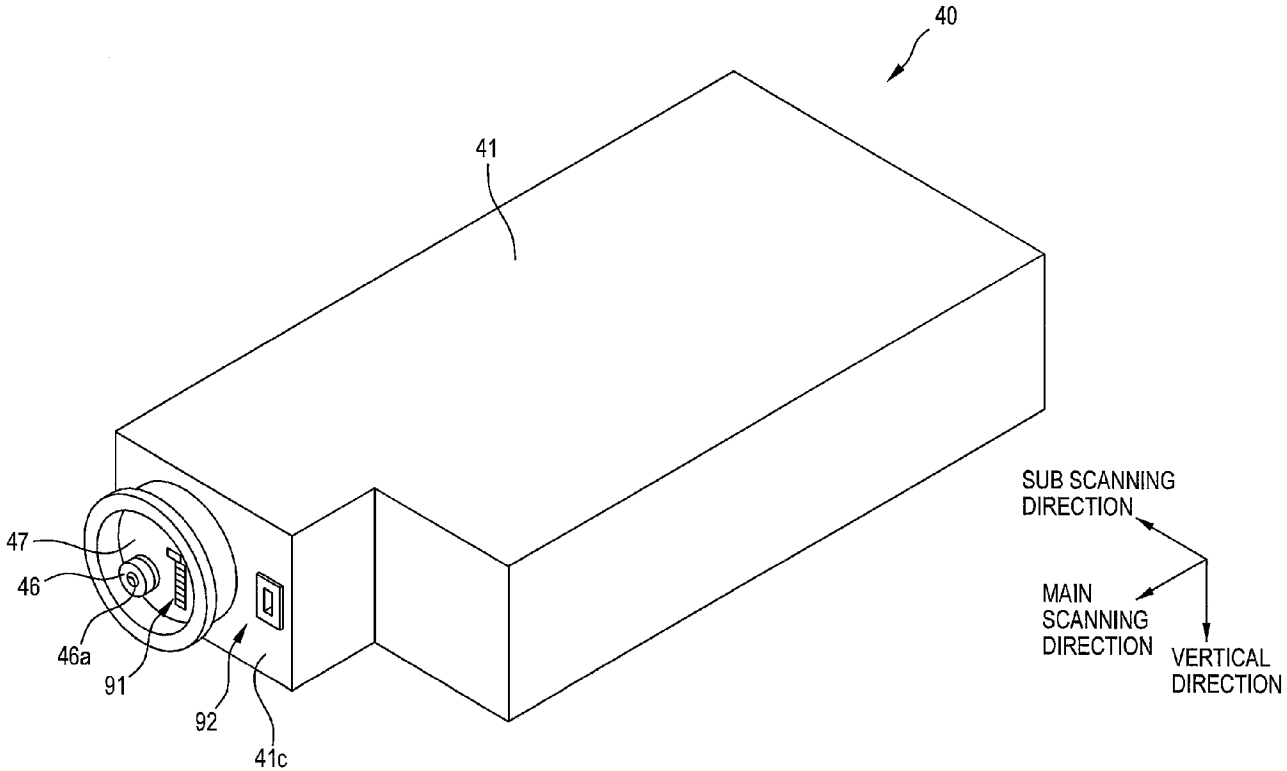
FIG. 5 is a perspective view of an ink cartridge according to the first embodiment of the present invention.
Figure 6:
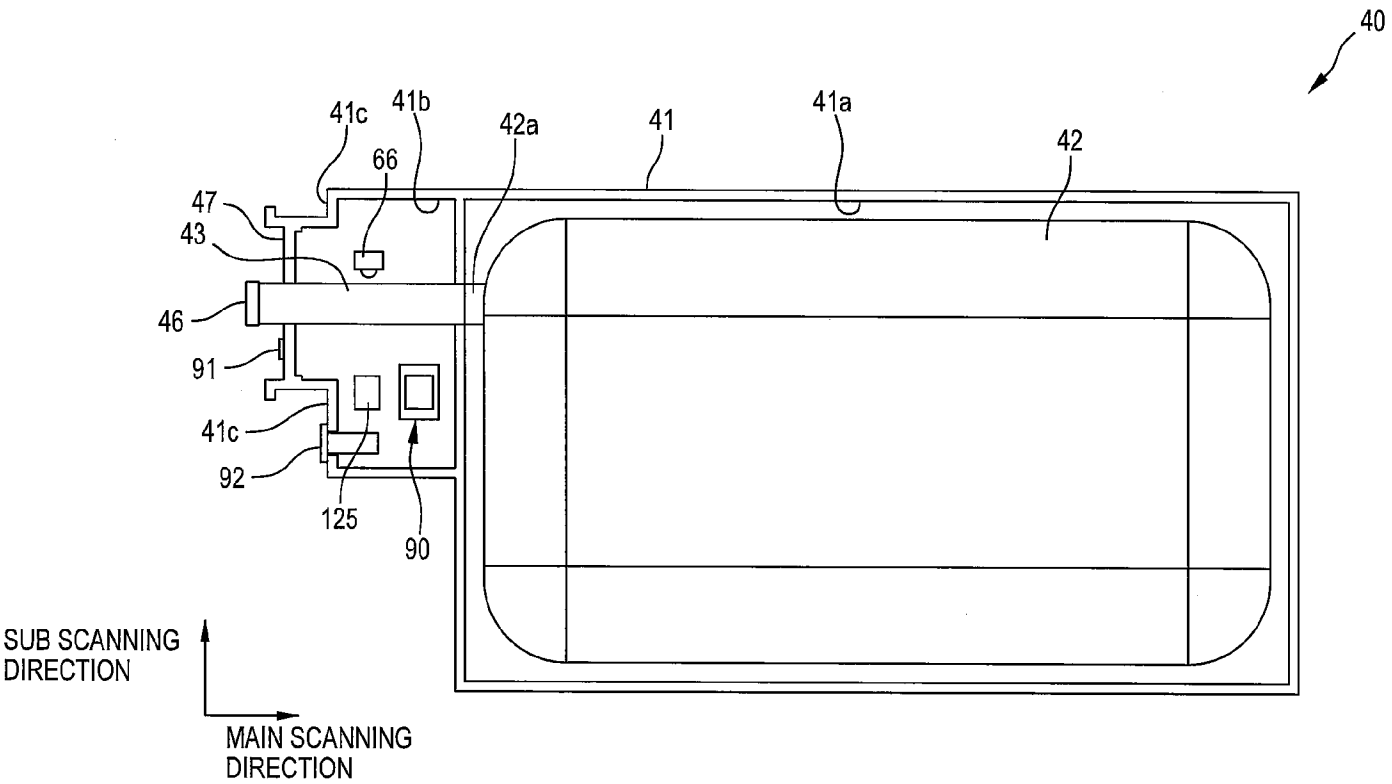
FIG. 6 is a schematic diagram showing the internal structure of the ink cartridge in FIG. 5.

Next, the ink cartridges 40 will be described with reference to FIGS. 5 through 8. Note that the bold lines in FIG. 8 indicate power supply lines, while the normal lines indicate signal lines. As shown in FIGS. 5 and 6, each ink cartridge 40 includes a case 41 having a substantially parallelepiped shape. As shown in FIG. 6, inside the case 41 are provided: an ink bag 42 (ink accommodating unit) that is filled with ink; an ink delivery tube 43 (ink delivery path) in communication with the ink bag 42 on one end; a controller 90; and a photosensor 66 (detecting unit, second detecting unit) and a storage unit 125 which are connected to the controller 90.

As shown in FIG. 6, the interior of the case 41 is partitioned into two chambers 41*a* and 41*b*. The ink bag 42 is provided in the chamber 41*a* on the right in FIG. 6, while the ink delivery tube 43, photosensor 66, controller 90, and storage unit 125 are disposed in the other chamber 41*b*. An air communication through-hole (not shown) is formed through the case 41 to communicate the interior of the case 41 to the outside. With this configuration, the ink bag 42 is applied with an atmospheric pressure. So, when the ink cartridge 40 is mounted in the inkjet printer 1, ink in the inkjet head 2 is applied with a negative pressure that is generated due to the pressure head difference between the inkjet head 2 and the ink bag 42.

As mentioned earlier, the ink cartridge 40 for accommodating black ink is larger in size and has greater ink storage capacity than the other three ink cartridges 40, but this difference is simply reflected in the chamber 41*a* and ink bag 42 being larger in the sub scanning direction. Since the four ink cartridges 40 have essentially the same structure, the following description of the ink cartridge 40 will pertain to all ink cartridges 40.

Figure 7A:
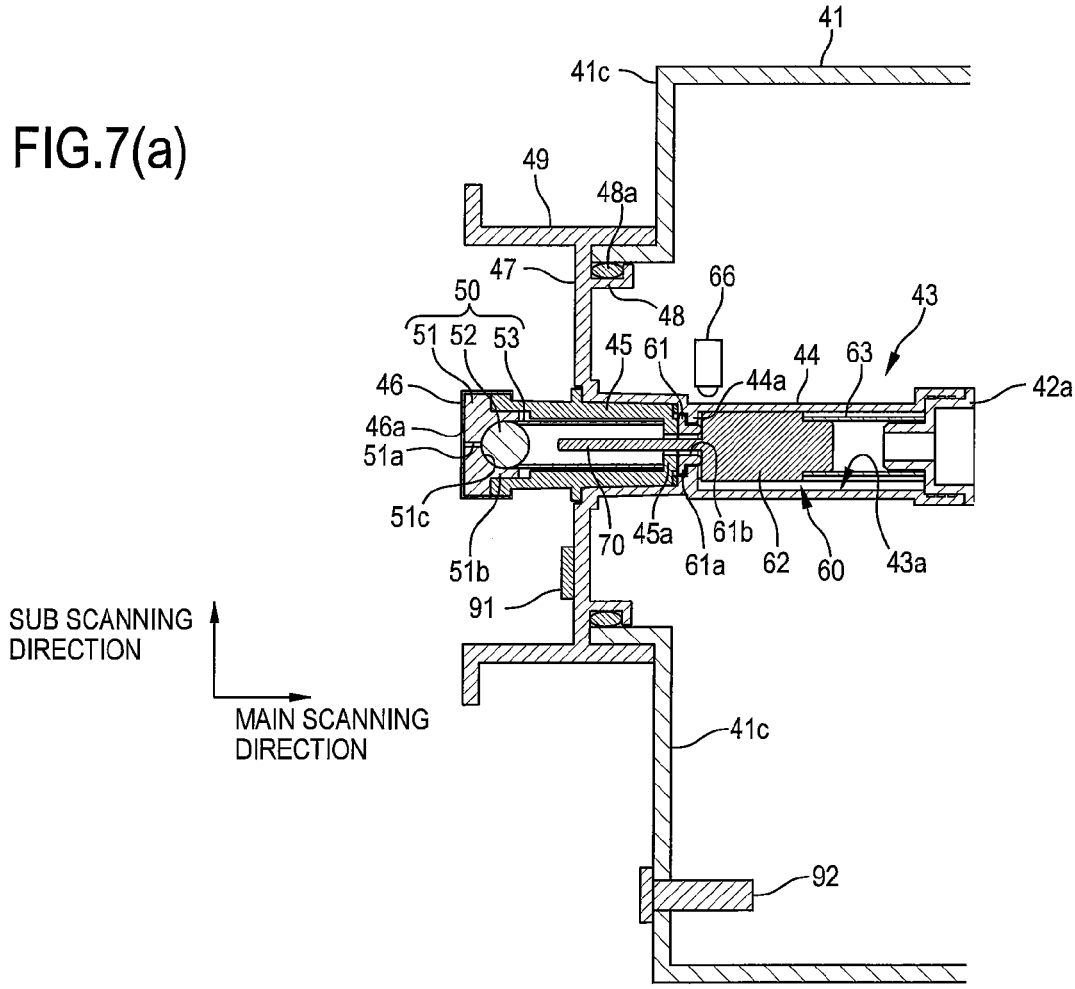
FIG. 7(*a*) is a partial cross-sectional view of the ink cartridge when first and second valves are closed.
Figure 7B:
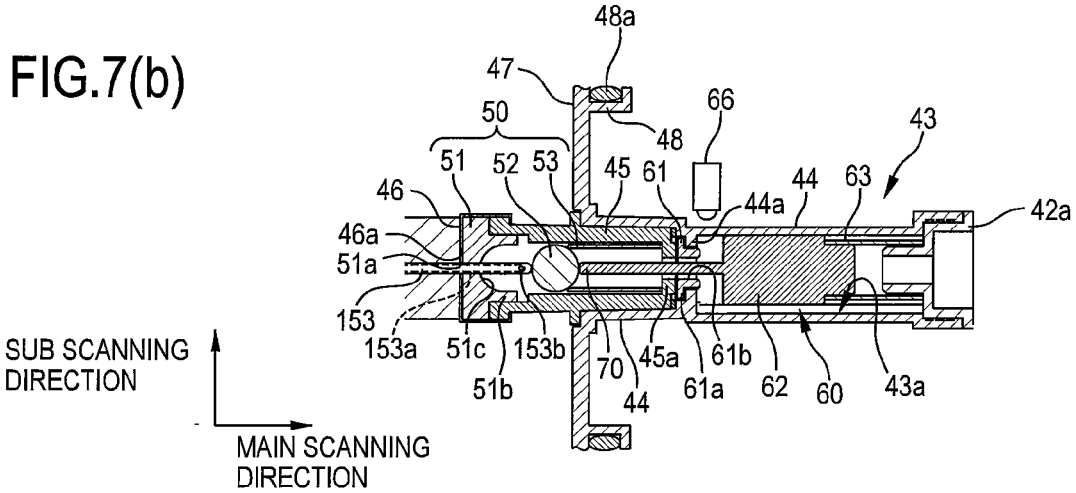

As shown in FIG. 7(*a*), the ink delivery tube 43 includes a tube 44 connected to a connector 42*a* provided on the ink bag 42, and a tube 45 fitted into the left end of the tube 44. An ink channel 43*a* (ink delivery path) is formed inside the ink delivery tube 43. The ink channel 43*a* extends in the main scanning direction and is in communication with the ink bag 42. In the embodiment, both the tubes 44 and 45 are constructed of a transparent resin material. By forming the tubes 44 and 45 of a transparent resin material, the photosensor 66 can detect a valve member 62 (moving body, second moving body), as will be described later. A cover 46 is provided over one end of the tube 45. An ink outlet 46*a* is formed in the cover 46.

As shown in FIGS. 5-7, an annular flange 47 is formed on one end of the tube 44. As shown in FIG. 7, the annular flange 47 is formed with a circular cylinder part 49 surrounding the outer periphery of the annular flange 47. The annular flange 47 is further formed with an annular protrusion 48 which is provided with an O-ring 48*a*. With this construction, the O-ring 48*a* seals the gap between the case 41 and annular protrusion 48, as shown in FIG. 7. The annular flange 47 of the embodiment forms part of the wall defining the chamber 41*b*.

As indicated in FIGS. 5-8, a contact point 91 is formed on the outer surface of the annular flange 47. The contact point 91 is juxtaposed with the ink outlet 46*a* along the sub scanning direction. The contact point 91 is connected to the controller 90. As a variation of the embodiment, the contact point 91 can be disposed at any position, provided that the contact point 91 is not positioned vertically below the ink outlet 46*a*. Disposing the contact point 91 of the signal transmission system at a position that is not directly beneath the ink outlet 46*a* can prevent ink from dripping out of the ink outlet 46*a* onto the contact point 91.

Figure 8:
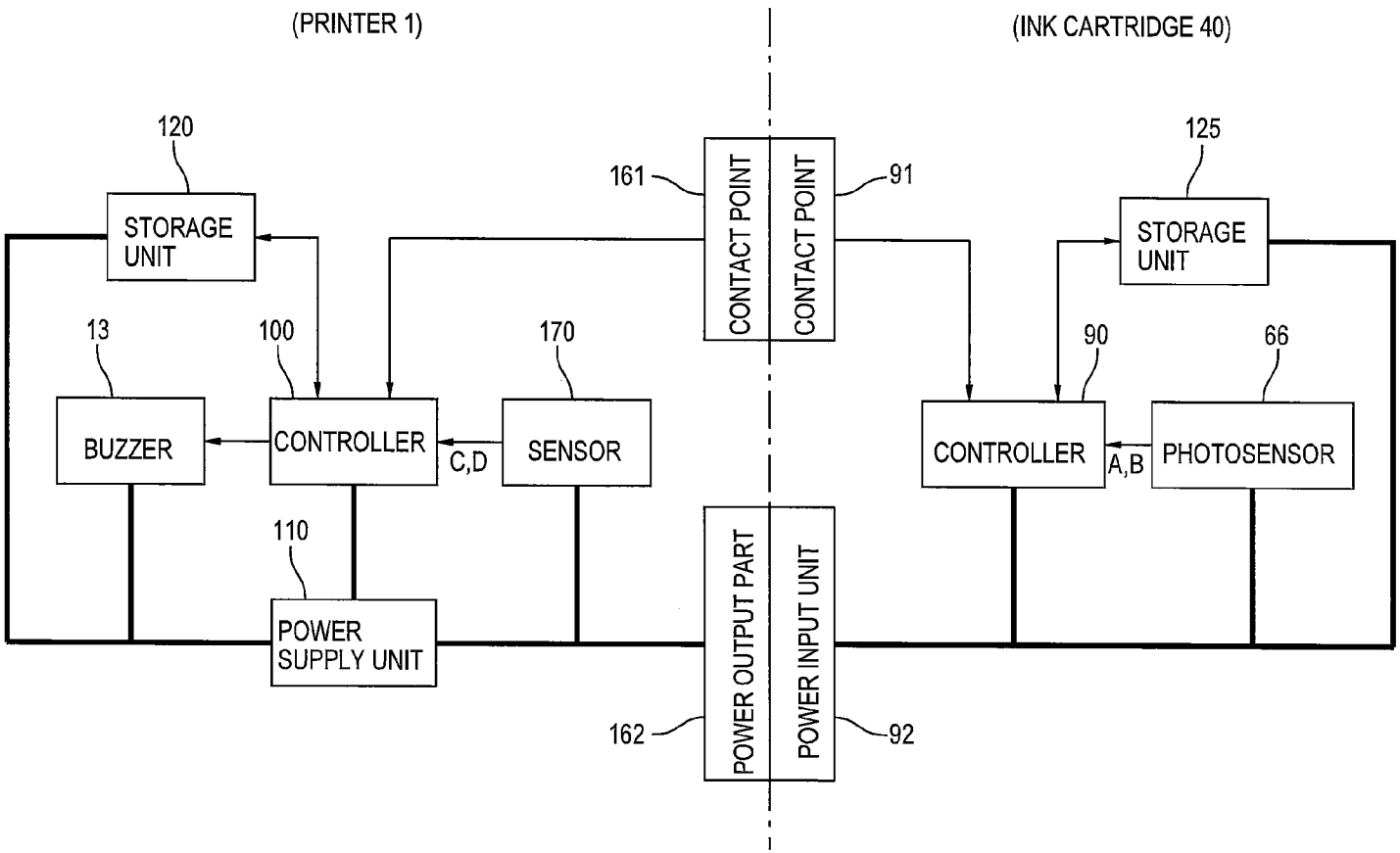
FIG. 8 is a block diagram showing the electrical structure of the inkjet printer and ink cartridge.

In addition, a power input unit 92 is disposed on a side surface of the case 41 on the ink outlet 46*a* side. A stepped surface 41*c* is formed on the case 41 so that the case 41 is recessed from the annular flange 47 toward the ink bag 42 in the main scanning direction between the ink outlet 46*a* and the power input unit 92. The power input unit 92 is provided on the stepped surface 41*c* and is positioned on the opposite side of the ink outlet 46*a* with respect to the contact point 91 in the sub scanning direction. In other words, the power input unit 92 is separated farther from the ink outlet 46*a* in the sub scanning direction than is the contact point 91. As shown in FIG. 8, the power input unit 92 is electrically connected to the controller 90 and the photosensor 66. Through an electrical connection with a power output part 162 in the recording device 1 side described later, the power input unit 92 supplies electricity to the controller 90 and the photosensor 66. As a variation of the embodiment, the power input unit 92 may be disposed at any position, provided that the position is not directly beneath the ink outlet 46*a*.

Disposing the power input unit 92 of the power transmission system at a position not directly beneath the ink outlet 46*a* in this way prevents ink dripping out of the ink outlet 46*a* from depositing on the power input unit 92. Further, by separating the power input unit 92 from the ink outlet 46*a* even farther than the contact point 91, it is even less likely that ink will become deposited on the power input unit 92, thereby ensuring that the power input unit 92 does not short-circuit and damage the controller 90 or the like. Further, by forming the stepped surface 41*c* between the power input unit 92 and ink outlet 46*a*, the power input unit 92 and ink outlet 46*a* are separated considerably in the main scanning direction as well as the sub scanning direction, thereby further ensuring that ink does not become deposited on the power input unit 92.

As shown in FIG. 7(*a*), a first valve 50 is disposed inside the tube 45 of the ink delivery tube 43. A second valve 60 is disposed inside the tube 44 of the ink delivery tube 43. The first valve 50 includes a flexible sealing member 51 for sealing the opening formed in the left end of the tube 45 (the ink delivery opening), a spherical member 52 (first moving body), and a coil spring 53. The cover 46 prevents the sealing member 51 from coming out of the tube 45.

One end of the coil spring 53 contacts the spherical member 52, and the other end contacts a stepped part 45*a* formed on the inner end of the tube 45 for constantly urging the spherical member 52 toward the sealing member 51. In the embodiment, the coil spring 53 is used as an urging member, but the urging member may be implemented by means other than a coil spring, provided that the spherical member 52 is urged toward the sealing member 51.

The sealing member 51 is configured of an elastic member formed of rubber or the like. The sealing member 51 has a slit 51*a* penetrating the center of the sealing member 51 in the main scanning direction, an annular protrusion 51*b* that can be fitted into the end of the tube 45, and a curved part 51*c* constituting the surface of the sealing member 51 opposing the spherical member 52 in the region surrounded by the annular protrusion 51*b*. The curved part 51*c* has a shape that conforms to the outer surface of the spherical member 52. The cross-sectional diameter of the slit 51*a* is slightly smaller than the diameter of a hollow needle 153 described later. Accordingly, when the hollow needle 153 is inserted into the slit 51*a*, the sealing member 51 elastically deforms so that the inner surface of the slit 51*a* is in close contact with the outer surface of the hollow needle 153, preventing ink from leaking between the slit 51*a* and the hollow needle 153.

The inner diameter of the annular protrusion 51*b* is slightly smaller than the diameter of the spherical member 52, and the slit 51*a* is sealed when the spherical member 52 contacts the inner surface of the annular protrusion 51*b*. More specifically, the slit 51*a* is sealed through contact between the spherical member 52 and curved part 51*c*. Further, the slit 51*a* formed in the sealing member 51 facilitates insertion of the hollow needle 153 into the sealing member 51. Further, because the slit 51*a* is formed in the sealing member 51, although the hollow needle 153 scrapes against the sealing member 51 when being inserted therein, shaving matter from the sealing member 51 is restricted from being generated and entering the hollow needle 153. Therefore, the shaving matter from the sealing member 51 can be prevented from entering the ink channel of the inkjet head 2.

With this construction, when the hollow needle 153 is inserted through the ink outlet 46*a* into the slit 51*a*, the distal end of the hollow needle 153 contacts the spherical member 52 and pushes the spherical member 52 away from the curved part 51*c* and annular protrusion 51*b*, as shown in FIG. 7(*b*). At this time, the first valve 50 switches from a closed state to an open state. Further, a hole 153*b* formed in the hollow needle 153 described later has passed through the slit 51*a* when the first valve 50 is in the open state. So, the hollow needle 153 is in communication with the ink channel 43*a*. Conversely, when the hollow needle 153 moves in the opposite direction for being extracted from the slit 51*a*, the urging force of the coil spring 53 moves the spherical member 52 toward the annular protrusion 51*b*. When the spherical member 52 comes into contact with the annular protrusion 51*b*, the first valve 50 is shifted from the open state back to the closed state. As the hollow needle 153 is further pulled out of the slit 51*a*, the spherical member 52 tightly contacts the curved part 51*c*. In this way, the first valve 50 takes on either the open state for allowing communication with the ink delivery tube 43 or the closed state for interrupting communication with the ink delivery tube 43 based on insertion or retraction of the hollow needle 153. Further, since the first valve 50 is provided with the coil spring 53 for urging the spherical member 52 toward the sealing member 51, the first valve 50 can suppress ink from leaking out of the first valve 50 through a simple construction.

As shown in FIG. 7(*a*), the second valve 60 includes a valve seat 61, the valve member 62, and a coil spring 63. The valve seat 61 is configured of an elastic member formed of rubber or the like. A flange 61*a* formed on the valve seat 61 is interposed between the stepped part 45*a* of the tube 45 and an annular protrusion 44*a* protruding inward from the inner surface of the tube 44 at a region near the center thereof. A through-hole 61*b* is formed in the center of the valve seat 61 and penetrates the valve seat 61 in the main scanning direction to allow communication between the tube 44 and tube 45.

One end of the coil spring 63 contacts the valve member 62, while the other end contacts the connector 42*a*. The coil spring 63 constantly urges the valve member 62 toward the valve seat 61. In other words, the coil spring 63 urges the valve member 62 in a direction toward the sealing member 51. By contacting the end of the valve seat 61 (the right end in FIG. 7(*a*); the peripheral edge of the through-hole 61*b*), the valve member 62 interrupts communication in the ink channel 43*a*, i.e., interrupts communication between the tube 44 and tube 45 and placing the second valve 60 in a closed state. At this time, the right end of the valve seat 61 is elastically deformed by the urging force of the coil spring 63. Further, since the coil spring 63 urges the valve member 62 in a direction toward the sealing member 51 and the elements constituting the first and second valves 50 and 60 are aligned in the main scanning direction, the first and second valves 50 and 60 can be opened and closed by the insertion and removal of the hollow needle 153 with respect to the sealing member 51. Further, the second valve 60 can be configured through a simple construction that reduces the chance of malfunctions. Here, an urging member other than a coil spring may be used in place of the coil spring 63.

The valve member 62 has a columnar shape extending in the main scanning direction and can slide along the inner surface of the tube 44. The endface of the valve member 62 on the connector 42*a* side protrudes farther in the main scanning direction in the center region thereof. The coil spring 63 is fixed to the valve member 62 by fitting the coil spring 63 over the protruding part of the valve member 62.

A pressing member 70 is also disposed inside the ink delivery tube 43 between the spherical member 52 and valve member 62. The pressing member 70 moves the valve member 62 against the urging force of the coil spring 63 when the hollow needle 153 is inserted into the first valve 50. The pressing member 70 is rod-shaped and extends in the main scanning direction. The pressing member 70 is integrally formed with the valve member 62 on the end opposing the valve seat 61. The pressing member 70 has a smaller diameter than the through-hole 61*b* and is disposed within the through-hole 61*b*. The length of the pressing member 70 is such a value that forms a gap between the distal end of the pressing member 70 and the spherical member 52 when the first valve 50 changes from the open state to the closed state (i.e., when the spherical member 52 moves from a position separated from the sealing member 51 and contacts the annular protrusion 51*b*) while the valve member 62 is in contact with the valve seat 61 (the second valve 60 is in the closed state).

With this construction, after the hollow needle 153 is inserted into the first valve 50 and the first valve 50 switches to the open state, the hollow needle 153 pushes the spherical member 52 and the spherical member 52 contacts the distal end of the pressing member 70, as shown in FIG. 7(*b*). As the hollow needle 153 is inserted further, the pressing member 70 and valve member 62 continue to move, and the valve member 62 separates from the valve seat 61, causing the second valve 60 to change from the closed state to the open state. Since communication is now established between parts of the ink channel 43*a* in the tubes 44 and 45, ink in the ink bag 42 flows into the hollow needle 153. Conversely, when the hollow needle 153 is pulled out of the first valve 50, the urging force of the coil spring 63 moves the valve member 62 and the pressing member 70 until the valve member 62 is pressed tightly against the valve seat 61, thereby changing the second valve 60 from an open state to a closed state, as described above for the first valve 50. Accordingly, the second valve 60 also enters either the open state for providing communication throughout the ink channel 43*a* of the ink delivery tube 43 or the closed state for interrupting communication in the ink channel 43*a* based on insertion and retraction of the hollow needle 153.

The photosensor 66 is capable of detecting the presence of an object without contact. The photosensor 66 is disposed in a position for opposing the downstream end of the valve member 62 when the second valve 60 blocks communication within the ink channel 43*a*, as shown in FIG. 7(*a*), and so as not to oppose the valve member 62 when the second valve 60 does not interrupt communication within the ink channel 43*a*, as shown in FIG. 7(*b*). The photosensor 66 may be configured of a reflective-type optical sensor having a light-emitting element and a light-receiving element, for example. In this case, at least a portion of the valve member 62 is formed of a reflective surface capable of reflecting light. Therefore, when the valve member 62 is opposite the photosensor 66, light emitted from the light-emitting element is reflected off the reflective surface of the valve member 62 and received by the light-receiving element. Upon receiving the reflected light, the photosensor 66 outputs, to the controller 90, a signal indicating that the light-receiving element has received light (hereinafter referred to as a signal A). This signal A is relayed from the controller 90 to the controller 100 of the inkjet printer 1, as indicated by the signal lines in FIG. 8. On the other hand, when the valve member 62 is not positioned opposite the photosensor 66, light emitted by the light-emitting element is not reflected off the reflective surface of the valve member 62 and, hence, the light-receiving element does not receive reflected light. At this time, the photosensor 66 outputs, to the controller 90, a signal indicating that the light-receiving element is not receiving light (hereinafter referred to as a signal B). This signal B is also relayed from the controller 90 to the controller 100 of the inkjet printer 1. Upon receiving these signals, the controller 100 can distinguish when the second valve 60 is in the open state and the closed state. In the embodiment, the controller 100 detects that the second valve 60 is in the closed state when receiving the signal A indicating that the light-receiving element has received light and detects that the second valve 60 is in the open state upon receiving the signal B indicating that the light-receiving element is not receiving light. While the photosensor 66 is described as a reflective sensor in the embodiment, the present invention is not limited to this type of sensor. For example, the photosensor 66 may be configured of a transmissive-type optical sensor.

The storage unit 125 stores the data shown in Table 1 below. Table 1 indicates the necessity for a maintenance operation (ink forcibly ejecting operation to forcibly eject ink from a recording head) on an inkjet head 2 and the amount of ink leakage from ejection holes in the inkjet head 2 (the amount of ink flowing out of the ink accommodating unit) when an ink cartridge 40 is mounted in a mounting unit 150 described later. More specifically, Table 1 indicates the necessity for a maintenance operation and the quantity of ink leakage for each of combinations of: four time ranges T1-T4; and four ink volume ranges V1-V4. In this example, time range T1 is set to a range greater than or equal to 0 seconds and less than 0.5 seconds, time range T2 to a range greater than or equal to 0.5 seconds and less than 1.5 seconds, time range T3 to a range greater than or equal to 1.5 seconds and less than 2.5 seconds, and time range T4 to a range greater than or equal to 2.5 seconds. Further, ink volume range V1 is set to a range greater than or equal to 0 ml and less than 500 ml, ink volume range V2 to a range greater than or equal to 500 ml and less than 700 ml, ink volume range V3 to a range greater than or equal to 700 ml and less than 800 ml, and ink volume range V4 to a range greater than or equal to 800 ml and less than 1,000 ml.

TABLE 1

| | | Ink volume range | | | |
|---|---|---|---|---|---|
| | | V1 | V2 | V3 | V4 |
| Time range | T1 | Maintenance not required No ink leakage occurs | Maintenance required ink leakage occurs (ink of almost 0 ml) | Maintenance required ink leakage occurs (very slight amount of ink) | Maintenance required ink leakage occurs (some ink) |
| | T2 | Maintenance not required No ink leakage occurs | Maintenance not required No ink leakage occurs | Maintenance required ink leakage occurs (ink of almost 0 ml) | Maintenance required ink leakage occurs (very slight amount of ink) |
| | T3 | Maintenance not required No ink leakage occurs | Maintenance not required No ink leakage occurs | Maintenance not required No ink leakage occurs | Maintenance required ink leakage occurs (ink of almost 0 ml) |
| | T4 | Maintenance not required No ink leakage occurs | | | |

Hence, for the case where the mounted ink cartridge 40 has an ink volume falling within ink volume range V1, the Table 1 indicates that no ink leakage occurs and that maintenance is not necessary, regardless of which time range T1-T3 corresponds to the mounting time. Here, the mounting time indicates the time elapsed between the moment that the ink cartridge 40 was beginning to be mounted in the mounting unit 150 and the moment that the second valve 60 in the ink cartridge 40 switched from the closed state to the open state.

For the case where the mounted ink cartridge 40 has an ink volume that falls within ink volume range V2, the Table 1 indicates that ink leakage with an amount of almost zero (0) ml occurs and maintenance is necessary only when the mounting time falls within time range T1. In other words, the Table 1 indicates that a small amount of ink may possibly leak and maintenance is necessary when the mounting time is less than 0.5 seconds. Thus, 0.5 seconds is the threshold for indicating whether or not maintenance will be required.

For the case where the mounted ink cartridge 40 has an ink volume that falls within ink volume range V3 and the mounting time falls within time range T1, the Table 1 indicates that a very slight amount of ink leaks (approximately 1 ml, for example) and that maintenance is necessary. For the case where the mounted ink cartridge 40 has an ink volume that falls within ink volume range V3 and the mounting time falls within time range T2, the Table 1 indicates that ink of almost zero (0) ml leaks and that maintenance is necessary. In other words, maintenance is required when the ink volume of the mounted ink cartridge 40 falls within ink volume range V3 and the mounting time is less than 1.5 seconds, but unnecessary if the mounting time is longer.

For the case where the mounted ink cartridge 40 has an ink volume that falls within ink volume range V4, the Table 1 indicates that maintenance is necessary, regardless of which time range T1-T3 corresponds to the mounting time. The Table 1 also indicates that a small amount of ink leaks (about 3 ml, for example) when the mounting time falls within time range T1, that a very slight amount of ink leaks when the mounting time falls within time range T2, and that ink of almost zero (0) ml leaks when the mounting time falls within time range T3. It is noted that the Table 1 further indicates that ink does not leak and maintenance is unnecessary when the mounting time is greater than 2.5 seconds, that is, when the mounting time falls in a time range T4, if the volume of ink in the ink cartridge 40 is less than 1,000 ml.

In this way, the storage unit 125 stores data specifying prescribed threshold times (0, 0.5, 1.5, and 2.5 seconds) corresponding to the respective ink volume ranges V1-V4 for which maintenance becomes necessary. In other words, the storage unit 125 stores the prescribed time 0 seconds for ink volume range V1, the prescribed time of 0.5 seconds for ink volume range V2, the prescribed time of 1.5 seconds for ink volume range V3, and the prescribed time of 2.5 seconds for ink volume range V4. These prescribed times are increased further as the quantities of ink specified by ink volume ranges V1-V4 are increased.

A manufacturer of the ink cartridge 40 creates the Table 1 by performing an experiment. During the experiment, the manufacturer prepares a plurality of ink cartridges 40 that are filled with ink of various volumes. The manufacturer mounts the ink cartridges 40 in the mounting unit 150 of the inkjet printer 1 at various speeds. The manufacturer measures the amount of ink leakage from the ejection holes of the inkjet head 2.

The storage unit 125 is configured of flash memory that can be overwritten by the controller 90 or an external device, such as the controller 100 of the inkjet printer 1, and stores data specifying quantity of ink stored in the ink cartridge 40 that is provided with the storage unit 125. Hence, after performing a printing operation or a purge operation, the controller 100 can subtract the quantity of ink consumed in the printing operation or purge operation from the ink quantity in the ink cartridge 40 prior to the operation and update the data stored in the storage unit 125 with the resulting quantity of residual ink. Further, since the storage unit 125 stores the quantity of leaked ink, the quantity of remaining ink can be corrected when overwriting the ink quantity in the storage unit 125. That is, the controller 90 can update the quantity of remaining ink by subtracting the amount of ink that is leaked when the ink cartridge 40 is mounted. Accordingly, the storage unit 125 can accurately store the current amount of residual ink.

Further, when an ink cartridge 40 that has run out of ink is refilled in order to be reused in the inkjet printer 1, the data indicating the quantity of ink in the ink cartridge 40 can easily be overwritten, even when the specifications of the ink cartridge 40 itself have changed, such as when the quantity of ink dispensed or refilled at the factory or the like is greater than or less than the original prescribed quantity. Moreover, since the storage unit 125 is provided in the ink cartridge 40, the storage capacity of memory in the printer body itself can be reduced.

Next, mounting units 150 formed in the body of the inkjet printer 1 will be described with reference to FIGS. 8 and 9. Four of the mounting units 150 juxtaposed in the sub scanning direction are provided in the printer body for receiving the respective ink cartridges 40 when mounting the ink cartridges 40 in the printer body. Since the mounting units 150 have substantially the same structure, only one of the mounting units 150 will be described below.

Figure 9A:
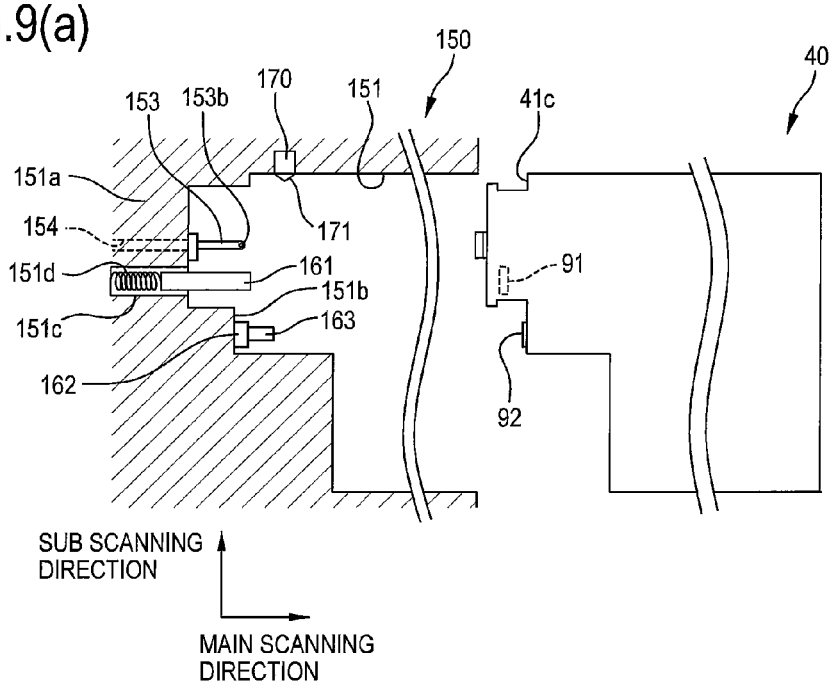
FIGS. 9(*a*) and 9(*b*) are partial cross-sectional views showing the state how the ink cartridge is mounted in a mounting unit of the printer, wherein FIG. 9(*b*) shows the state prior to when the ink cartridge is mounted in the mounting unit, and FIG. 9(*b*) shows the state how the ink cartridge is mounted in the mounting unit.
Figure 9B:
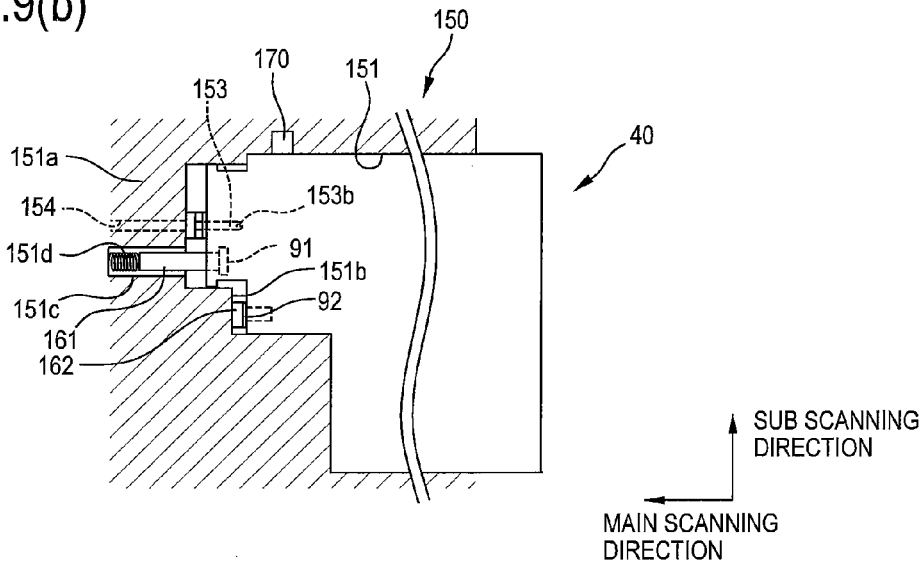

As shown in FIG. 9, the mounting unit 150 has a recessed part 151 that conforms to the outer shape of the ink cartridge 40. The recessed part 151 has the most inward part 151*a* in the main scanning direction. On the most inward part 151*a*, there are provided the hollow needle 153 (hollow tube), the ink supply channel 154, a contact point 161 electrically connected to the controller 100, and the power output part 162 for outputting electricity produced by a power supply unit 110 (see FIG. 8) provided in the printer body.

The hollow needle 153 is fixedly disposed at a position opposite the slit 51*a* of the mounted ink cartridge 40 and is longitudinally oriented in the main scanning direction. The hollow needle 153 has an inner hollow region 153*a* in fluid communication with the ink supply channel 154, and a hole 153*b* formed near the distal end thereof for providing external communication with the hollow region 153*a* (see also FIG. 7(*b*)). With this construction, the hollow needle 153 is in a state of communication with the tube 45 side of the ink channel 43*a* when the ink cartridge 40 is mounted in the printer body and the hole 153*b* has passed through the slit 51*a*. However, communication between the hollow needle 153 and the ink channel 43*a* is interrupted when the hole 153*b* is inside the slit 51*a* as the ink cartridge 40 is being removed from the printer body. Note that while communication between the hollow needle 153 and ink channel 43*a* is established when the hole 153*b* passes through the slit 51*a*, ink does not flow from the ink bag 42 into the hollow region 153*a* until the second valve 60 has changed to an open state. Further, the paths from the hole 153*b* of the hollow needle 153 to the ejection holes in the inkjet head 2 are hermetically sealed channels that are not exposed to the outside air. Accordingly, it is possible to suppress an increase in ink viscosity since the ink in these channels is not exposed to air.

The contact point 161 is juxtaposed with the hollow needle 153 in the sub scanning direction and positioned opposite the contact point 91 of the mounted ink cartridge 40. The contact point 161 is configured of a rod-shaped member that extends in the main scanning direction and is slidably supported in a hole 151*c* that is formed in the most inward part 151*a* and that is elongated in the main scanning direction. A spring 151*d* is provided in the hole 151*c* and urges the contact point 161 outward from the hole 151*c* so that the contact point 161 makes an electrical connection with the contact point 91 just prior to the hollow needle 153 being inserted into the sealing member 51 when the ink cartridge 40 is mounted in the printer body. In other words, the contact point 161 is electrically connected to the contact point 91 before the first valve 50 changes to an open state. Conversely, when the ink cartridge 40 is removed from the printer body, the contact point 161 remains electrically connected to the contact point 91 until the hollow needle 153 is extracted from the sealing member 51.

The power output part 162 is provided in a stepped surface 151*b* formed on the most inward part 151*a*. The power output part 162 is disposed at a position opposing the power input unit 92 of the mounted ink cartridge 40. The power output part 162 also has a contact point 163 that protrudes outward in the main scanning direction. When the ink cartridge 40 is mounted in the printer body, the contact point 163 is inserted into the power input unit 92 and forms an electrical connection with the same. As with the contact point 161, the contact point 163 becomes electrically connected to the power input unit 92 just before the hollow needle 153 enters the sealing member 51.

A sensor 170 (first detecting unit) is also provided in the recessed part 151 of each mounting unit 150. The sensor 170 is connected to the controller 100 and serves to detect the case 41 of the ink cartridge 40. Specifically, the sensor 170 is a mechanical switch-type sensor that detects the presence of an object through contact. The sensor 170 includes a detecting part 171 that is urged out of the sensor 170 into the recessed part 151. When the stepped surface 41*c* of the case 41 of the ink cartridge 40 contacts the detecting part 171 and pushes the detecting part 171 into the sensor 170, the sensor 170 outputs a signal indicating the retracted state of the detecting part 171 (hereinafter referred to as signal C) to the controller 100. When the ink cartridge 40 is removed from the mounting unit 150, eliminating contact between the case 41 and detecting part 171 and enabling the detecting part 171 to emerge again from the sensor 170, the sensor 170 outputs a signal indicating this protruding state of the detecting part 171 (hereinafter referred to as signal D) to the controller 100. Upon receiving these signals, the controller 100 can determine whether the ink cartridge 40 is mounted in the mounting unit 150. In the embodiment, the controller 100 determines that the ink cartridge 40 is either mounted in the mounting unit 150 or positioned near the mounting position within the mounting unit 150 upon receiving signal C indicating that the detecting part 171 is retracted in the sensor 170, and determines that the ink cartridge 40 is not mounted in the mounting unit 150 upon receiving signal D indicating that the detecting part 171 is protruding from the sensor 170. The sensor 170 may also be configured of a photosensor and the like and is not limited to a mechanical switch-type sensor.

As shown in FIG. 2(*a*), the inkjet printer 1 also includes a buzzer 13 (notifying unit) disposed in the casing 1*a*. The controller 100 controls the buzzer 13 to emit various sounds. The sounds are designed to alert the user when, for example, no data is stored in the storage unit 125, the ink cartridge 40 is not mounted correctly, and it is OK to print. The sounds are designed also to ask the user as to whether a maintenance operation should be performed.

Figure 10:
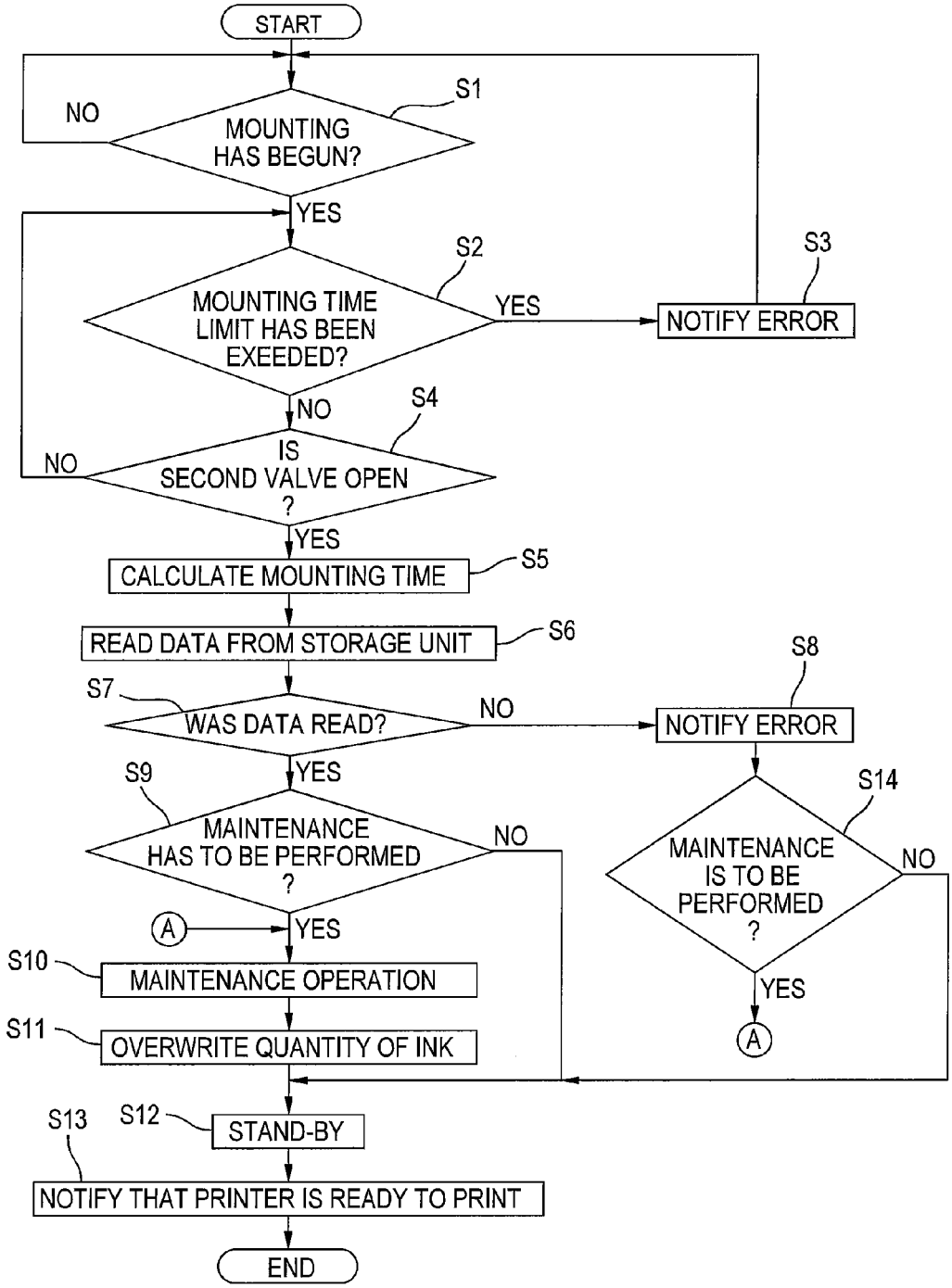
FIG. 10 is a flowchart illustrating steps in a control process performed by controllers in the inkjet printer and the ink cartridge according to the first embodiment when the ink cartridge is mounted in the mounting unit of the printer.

As shown in FIG. 8, a storage unit 120 is provided in the casing 1*a*. The storage unit 120 is electrically connected to the controller 100 and power supply unit 110. A program executed by the controllers 100 and 90 as will be described with reference to FIG. 10 is stored in the storage unit 120. A mounting time limit to be described later is also stored in the storage unit 120. Additionally, a manipulation unit (not shown) is provided in the casing 1*a*, enabling the user to input his/her instruction, such as an instruction to or not to perform a maintenance operation.

Next, operations performed by the controller 100 of the inkjet printer 1 and the controller 90 of the ink cartridge 40 when an ink cartridge 40 is being mounted into the printer body will be described with reference to the flowchart in FIG. 10. The process described in FIG. 10 begins when the operator opens the door 1*c* on the printer body to mount one of the four ink cartridges 40 in the respective mounting unit 150. At this time, in S1 of the process in FIG. 10, the controller 100 determines whether mounting of the ink cartridge 40 in the mounting unit 150 has begun. The controller 100 makes this determination when the case 41 of the ink cartridge 40 contacts the detecting part 171 of the sensor 170, causing the signal outputted from the sensor 170 to change from signal D to signal C and the controller 100 to receive this signal C. The position of the ink cartridge 40 relative to the direction in which the ink cartridge 40 is mounted in the mounting unit 150 when the signal outputted from the sensor 170 changes from signal D to signal C will be called the "first position." While continuing to receive the signal D from the sensor 170, the controller 100 determines that mounting has not begun and continues to wait. When the signal C is received from the sensor 170, the controller 100 determines that mounting has begun and advances to S2.

In S2 the controller 100 determines whether a mounting time limit has elapsed since the signal C was received and before a signal B has been received from the photosensor 66. Specifically, the controller 100 determines whether the amount of elapsed time after the signal C was received has exceeded the mounting time limit stored in the storage unit 120 (see FIG. 8). If the elapsed time exceeds the mounting time limit (S2: YES), in S3 the controller 100 controls the buzzer 13 to emit a sound for notifying the user that the ink cartridge 40 is not properly mounted in the mounting unit 150. The process returns from S3 back to S1. Some reasons in which the ink cartridge 40 was not properly mounted in the mounting unit 150 might include damage to the tip of the hollow needle 153 that prevents the hollow needle 153 from moving the valve member 62 or a break in the pressing member 70 that prevents the pressing member 70 from moving the valve member 62. On the other hand, if the signal B was received from the photosensor 66 before the elapsed time exceeds the mounting time limit (S2: NO), the controller 100 advances to S4.

In S4 the controller 100 determines whether the second valve 60 is in an open state. The controller 100 makes this determination based on whether the signal outputted from the photosensor 66 and received through the controller 90 has changed from signal A to signal B as the valve member 62 moves to a position not opposite the photosensor 66. The position of the ink cartridge 40 relative to the mounting direction when the signal outputted from the photosensor 66 changes from signal A to signal B will be called the "second position." The controller 100 returns to S2 when determining that the second valve 60 is in a closed state because the received signal is signal A, and advances to S5 when determining that the second valve 60 is in the open state because the received signal is signal B.

The operations that occur after the sensor 170 outputs the signal C and until the second valve 60 changes to the open state are as follows. First, in the period after the sensor 170 outputs the signal C to the controller 100 and until the hollow needle 153 is inserted into the slit 51*a*, the contact point 91 and contact point 161 become electrically connected and the contact point 163 of the power output part 162 and the power input unit 92 become electrically connected. These connections enable the two controllers 90 and 100 to be electrically connected to each other and to exchange signals and allow power to be supplied to the controller 90 and photosensor 66. Further, the connection formed between the contact points 91 and 161 enable the controller 100 to output a time signal to the controller 90 indicating the time at which the sensor 170 detected the start of the mounting operation (the time at which the controller 100 received the signal C from the sensor 170). Next, as the hollow needle 153 is inserted through the slit 51*a*, the tip of the hollow needle 153 contacts the spherical member 52, moving the spherical member 52 rightward in FIG. 7(*b*) away from the curved part 51*c* and annular protrusion 51*b* until the first valve 50 changes from the closed state to the open state. Subsequently, the spherical member 52 contacts the distal end of the pressing member 70, moving the pressing member 70 and valve member 62 rightward in FIG. 7(*b*). As the valve member 62 separates from the valve seat 61, the second valve 60 changes from the closed state to the open state. Since the contact point 91 and contact point 161 are electrically connected at this time, the controller 100 can receive the signal B outputted from the controller 90 when the second valve 60 enters the open state. In this way, the method for determining when the second valve 60 is in the open state in S4 also serves for determining whether the hollow needle 153 is properly inserted into the ink cartridge 40. In other words, it is possible to detect whether the hollow needle 153 has been properly inserted into the ink channel 43*a* by using the photosensor 66 to detect whether the valve member 62 is in a prescribed position separated from the valve seat 61 and, hence, to confirm whether an ink channel has been properly formed from the ink cartridge 40 to the printer body.

In S5 the controller 90 of the ink cartridge 40 calculates the mounting time elapsed between the moment that a signal B was received from the photosensor 66 and the moment that the mounting operation was first detected based on the time signal received from the controller 100. Specifically, the controller 90 calculates this mounting time by finding the difference between the time at which the ink cartridge 40 arrives at the first position in the mounting unit 150 (i.e., the time at which the sensor 170 transmitted the signal C) and the time at which the ink cartridge 40 arrives at the second position in the mounting unit 150 (i.e., the time at which the photosensor 66 transmitted the signal B). In S6 the controller 90 reads the current ink quantity and the data indicated in Table 1 stored in the storage unit 125. In S7 the controller 90 determines whether data was read from the storage unit 125 in S6. If the controller 90 was unable to read the above data because the data is not stored in the storage unit 125 (S7: NO), then the controller 90 outputs an error signal to the controller 100 and, upon receiving this error signal, the controller 100 controls the buzzer 13 in S8 to emit a sound alerting the user of a problem with the storage unit 125. The process proceeds from S8 to S14, in which the controller 100 controls the buzzer 13 to emit a sound asking the user whether to or not to perform a maintenance operation. If the user inputs, to the manipulation unit (not shown), his/her instruction to perform a maintenance operation (yes in S14), the process proceeds to S10 to be described later. If the user inputs his/her instruction not to perform a maintenance operation (no in S14), the process proceeds to S12 to be described later.

However, if the controller 90 determines that data was successfully read from the storage unit 125 (S7: YES), the controller 90 advances to S9.

In S9 the controller 90 determines within which of the time ranges T1, T2, T3, and T4 the mounting time calculated in S5 falls, determines within which of the ink volume ranges V1, V2, V3, and V4 the volume of ink in the mounted ink cartridge 40 falls, and determines whether maintenance has to be performed for the newly mounted ink cartridge 40 by referring to the Table 1. In other words, the controller 90 determines whether the mounting time for the current ink cartridge 40 (T1, T2, T3, or T4) is shorter than the prescribed time indicating the threshold for determining whether maintenance is required with respect to the ink volume range (V1, V2, V3, or V4), within which the ink volume in the currently mounted ink cartridge 40 falls.

If the controller 90 determines that maintenance is not required at this time (S9: NO), the controller 90 determines that no ink leaked from the inkjet head 2 and, therefore, advances to S12 and enters a standby state, i.e., a print-ready state.

However, if the controller 90 determines that maintenance is required (S9: YES), in S10 the controller 90 outputs a signal to the controller 100 requesting that maintenance be started. Upon receiving this signal, the controller 100 first controls the elevating mechanism to move the inkjet heads 2 from the printing position (see FIG. 2(*a*)) to the retracted position (see FIG. 4(*a*)) in order to perform a purge operation to purge ink from the inkjet head 2. Next, the controller 100 controls a drive motor to move the caps 31 to positions opposing the ejection surfaces 2*a* (see FIG. 4(*b*)). Next, the controller 100 controls a drive motor to move the caps 31 toward the respective ejection surfaces 2*a* and into a capping position (see FIG. 4(*c*)).

Subsequently, the controller 100 drives the pump 104 for a prescribed time in order to forcibly supply ink from the ink cartridge 40 to the inkjet head 2, thereby purging a prescribed quantity of ink from the inkjet head 2 while the inkjet head 2 is covered by the cap 31. Next, the controller 100 controls drive motors for returning the caps 31 from the capping position to their initial position. At this time, the controller 100 may also control a wiper mechanism in the maintenance unit 30 that includes a wiper and a drive motor for operating the wiper (not shown), for example, to wipe off ink deposited on the ejection surface 2*a*. Next, the controller 100 controls the elevating mechanism to return the inkjet heads 2 from the retracted position to the printing position. Once the inkjet heads 2 are returned to the printing position, the maintenance operation is complete. After performing this maintenance operation, the controller 100 outputs a signal to the controller 90 indicating that maintenance is complete.

Upon receiving notification that maintenance was completed, in S11 the controller 90 overwrites the quantity of ink stored in the storage unit 125. More specifically, the controller 90 first determines whether the amount of leaked ink is "ink of almost zero ml," a "very slight amount of ink," or "some ink," by referring to the table 1, subtracts this determined quantity of leaked ink and the quantity of ink expended in a purging operation from the quantity of ink stored in the storage unit 125, and updates the ink quantity in the storage unit 125 with the result. This is because it is known that ink of the same amount with the leaked ink flows out of the ink cartridge 40 when the ink cartridge 40 is mounted in the mounting unit 150. The quantity of ink expended during a purge operation may be set to a fixed amount, or may be suitably adjusted with consideration for environmental factors such as temperature. In the latter case, the controller 100 must notify the controller 90 of the amount of ink expended during the purge operation. Next, the controller 100 enters the standby state, i.e., the print-ready state, in S12.

In S13 the controller 90 outputs a signal to the controller 100 indicating that the ink cartridge 40 is print-ready. After receiving this signal, the controller 100 controls the buzzer 13 to emit a sound for notifying the user that the printer 1 is ready to print, and the operation for mounting the ink cartridge 40 is complete. The operation for updating the ink quantity of the ink cartridge 40 described in S11 may instead be performed after the operation in S13 and before the controller 100 begins a printing operation.

It is noted that during the printing process, the controller 100 does not drive the pump 104. When ink is ejected from the ejection surface 2*a* of the inkjet head 2 to perform printing operation, ink of the same amount with the ejected ink is drawn into the inkjet head 2 from the ink cartridge 40 due to a capillary force.

With the inkjet printer 1 according to the embodiment, the controller 100 or the controller 90 updates the quantity of residual ink in the ink cartridges 40 not only in S11 of the mounting operation, but also after printing operations by subtracting the quantity of ink consumed during the printing operation or the like from the quantity of ink stored in the storage unit 125 before the printing operation was performed. It is noted that the quantity of ink consumed during the printing operation is determined based on print data based on which the printing operation is executed. Thus, if an ink cartridge 40 containing at least some residual ink is temporarily removed from the mounting unit 150 and subsequently remounted in the mounting unit 150, the controller 100 can limit the maintenance operations performed on the inkjet heads 2 to only those cases in which the mounting time calculated by the controller 90 during the mounting operation is less than a prescribed time associated with the quantity of residual ink in the mounted ink cartridge 40, thereby reducing the number of unnecessary maintenance operations.

Next, the operations performed when an ink cartridge 40 is removed from the printer body will be described. When an ink cartridge 40 has run out of ink, for example, the operator opens the door 1*c* and removes the ink cartridge 40 from the printer body. As the ink cartridge 40 moves out of the printer body, the spherical member 52, valve member 62, and pressing member 70 move leftward in FIG. 7(*b*) by the urging forces of the coil springs 53 and 63 while remaining in contact with each other. That is, the spherical member 52, pressing member 70, and valve member 62 operate in reverse to that described when the hollow needle 153 is inserted. Thus, the valve member 62 contacts the valve seat 61, shifting the second valve 60 from the open state to the closed state and halting the flow of ink from the ink cartridge 40 into the hollow needle 153. At this time, the signal outputted from the photosensor 66 to the controller 90 changes from signal B to signal A, at which time the controller 90 detects that the second valve 60 is in the closed state.

Subsequently, only the spherical member 52 moves with the hollow needle 153 so as to separate from the distal end of the pressing member 70. The first valve 50 changes from the open state to the closed state when the spherical member 52 contacts the annular protrusion 51*b* and curved part 51*c*. In this way, the first valve 50 and second valve 60 are automatically switched from their open states to their closed states as the hollow needle 153 is withdrawn, with the first valve 50 changing to the closed state after the second valve 60 changes to the closed state.

After the hollow needle 153 is extracted from the sealing member 51, the contact point 91 and contact point 161 are disconnected and the power input unit 92 and contact point 163 are disconnected as the ink cartridge 40 continues to be removed. When the case 41 separates from the detecting part 171 so that the detecting part 171 protrudes out from the sensor 170, the sensor 170 outputs the signal D to the controller 100, by which signal the controller 100 can determine that the ink cartridge 40 has been removed from the printer body. Thereafter, the operator replaces the ink cartridge 40 that was removed from the printer body with a new ink cartridge 40, mounting the new ink cartridge 40 in the printer body according to the procedure described above.

Next, steps performed when manufacturing and recycling an ink cartridge will be described. To manufacture a new ink cartridge in the embodiment, first the case 41 is manufactured in halves. Components of the ink cartridge 40, such as the ink bag 42 and ink delivery tube 43 are then assembled in one half of the case 41, as shown in FIG. 6. Next, the other half of the case 41 is joined with the first half, thereby completing the basic structure of an empty cartridge not yet filled with ink. Next, a dispenser is used to dispense a prescribed quantity of ink into the ink bag 42 of the cartridge. Then, data indicating the values shown in Table 1 and data indicating the quantity of dispensed ink are copied from a storage device into the storage unit 125 of the ink cartridge 40, thereby completing the ink cartridge manufacturing process.

As a variation of this process, when assembling the components of the ink cartridge 40 in one half of the case 41, the ink bag 42 may be pre-filled with ink before being installed in the case 41. Subsequently, the other half of the case 41 is joined with the first half, and the prescribed data is copied from a storage device into the storage unit 125.

On the other hand, when restoring a used ink cartridge 40 for reuse, the insides of the ink bag 42 and ink delivery tube 43 must first be cleaned. Next, a dispenser is used to refill the ink bag 42 with a prescribed amount of ink. Then, the old data stored in the storage unit 125 of the ink cartridge 40 indicating the residual ink quantity before the ink cartridge 40 was cleaned and refilled is overwritten by using a storage device by data indicating the quantity of ink dispensed during the refilling operation. This completes the process to recycle the ink cartridge 40.

With the inkjet printer 1 according to the embodiment described above, the controller 90 calculates the mounting time for an ink cartridge 40 when the ink cartridge 40 is mounted in its corresponding mounting unit 150. More specifically, by considering a first position to be the position of the ink cartridge 40 in the mounting direction when the sensor 170 detects the ink cartridge 40 (when the case 41 of the ink cartridge 40 contacts the detecting part 171 of the sensor 170, causing the signal outputted from the sensor 170 to change from signal D to signal C) and a second position to be the position of the ink cartridge 40 in the mounting direction when the second valve 60 changes to the open state (when the valve member 62 moves from a position confronting the photosensor 66 to a position not confronting the photosensor 66, causing the signal outputted from the photosensor 66 to change from signal A to signal B), it is possible to determine how fast the ink cartridge 40 was mounted in the mounting unit 150 by calculating the time required for the ink cartridge 40 to move between the first and second positions since the distance between these positions in the mounting direction is a fixed distance (predetermined distance). The calculated time is referred to as the "mounting time."

For example, if the ink cartridge 40 is mounted slowly, the mounting time will be long, resulting in a small change in ink pressure during the mounting operation. On the other hand, if the ink cartridge 40 is mounted quickly, the mounting time will be short, resulting in a large fluctuation in ink pressure during the mounting operation. Next, the controller 90 determines whether the calculated mounting time is less than a prescribed time based on the data shown in Table 1, i.e., whether maintenance is required. Therefore, it is possible to ensure that maintenance is performed on the inkjet head 2 when the ink cartridge 40 is mounted in the mounting unit 150 abruptly, maintaining the ink ejection characteristics of the inkjet head 2 to a desirable state.

In addition, the storage unit 125 stores a prescribed time for each of the ink volume ranges V1-V4 as a threshold value for determining whether maintenance is required. Hence, it is possible to restrict when maintenance operations are performed on an inkjet head 2 to those cases in which the mounting time calculated by the controller 90 is less than the prescribed time associated with the relevant ink volume range V1-V4, thereby reducing the number of unnecessary maintenance operations. These prescribed times serving as threshold values can be increased as the quantities of ink indicated by the ink volume ranges V1-V4 grows larger. In this way, the need for maintenance on an inkjet head 2 can be more accurately determined in order to more reliably maintain the ink ejection characteristics of the inkjet head 2 at the desirable state.

With the ink cartridge 40 according to the embodiment, the maintenance unit 30 provided in the printer body and the controller 100 for controlling the maintenance unit 30 can perform maintenance on an inkjet head 2 when the mounting time is determined to be less than the prescribed time stored in the storage unit 125, thereby maintaining the ink ejection characteristics of the inkjet head 2 to the desirable state. Further, according to the method of recycling the ink cartridge 40 of the embodiment, the ink cartridge 40 having the above effects can be reused.

As a first variation of the first embodiment, the sensor 170 may be disposed at a position for detecting the case 41 of the ink cartridge 40 when the first valve 50 changes from the closed position to the open position. In this case, the mounting start signal outputted from the sensor 170 to the controller 100 indicates that the first valve 50 is in the open state, while the removal signal indicates that the first valve 50 is in the closed state. In this variation, the annular protrusion 51*b* could be elongated in the main scanning direction, for example, so that the first valve 50 becomes open after the second valve 60 opens when the ink cartridge 40 is mounted in the mounting unit 150. Thus, the mounting time could be calculated as the time between the moment that the first valve 50 switches to the open state and the moment that the second valve 60 switches to the open state. In this way, the variation of the first embodiment can achieve the same effects as described in the first embodiment.

In a second variation of the first embodiment, a moving body may be provided in place of the second valve 60, whereby the moving body moves when contacted by the hollow needle 153 as the hollow needle 153 is inserted into the ink channel 43*a*. For example, the valve seat 61 may be omitted from the second valve 60 so that the second valve 60 will serve as a moving body but not as a valve. In this case, in S4 the controller 100 does not determine whether the second valve 60 is in an open state, but merely determines whether the hollow needle 153 was properly inserted into the ink cartridge 40. Further, an urging member is preferably provided for restricting movement of the moving body to within a prescribed range and for urging the moving body in a direction opposite the insertion direction of the hollow needle 153. The photosensor 66 may function to detect the position of the moving body. The second variation of the first embodiment can obtain the same effects as described in the first embodiment. However, the first valve 50 will require greater integrity to ensure that ink does not leak.

Second Embodiment

Next, an ink cartridge 240 according to a second embodiment of the present invention will be described with reference to FIG. 11. In the ink cartridge 240 according to the second embodiment, the ink delivery tube 43 has a tube 244, and the tube 45 that is fitted into the tube 244 similar to the structure in the first embodiment. However, the portion of the tube 244 in which the tube 45 is fitted is formed longer than that in the first embodiment so that the ink outlet 46*a* is closer to the annular flange 47 formed on the end of the tube 244. A photosensor 266 (first detecting unit) is also disposed in the case 41 in the second embodiment for detecting the open and closed states of the first valve 50. The photosensor 266 may be configured of a reflective-type optical sensor having a light-emitting element and a light-receiving element, for example. In this case, a reflective surface capable of reflecting light is formed on at least part of the spherical member 52. The photosensor 266 is connected to both the controller 90 and the power input unit 92. The remaining structure of the ink cartridge 240 is identical to the ink cartridge 40 described in the first embodiment and like parts and components are designated with the same reference numerals to avoid duplicating description.

Figure 11:
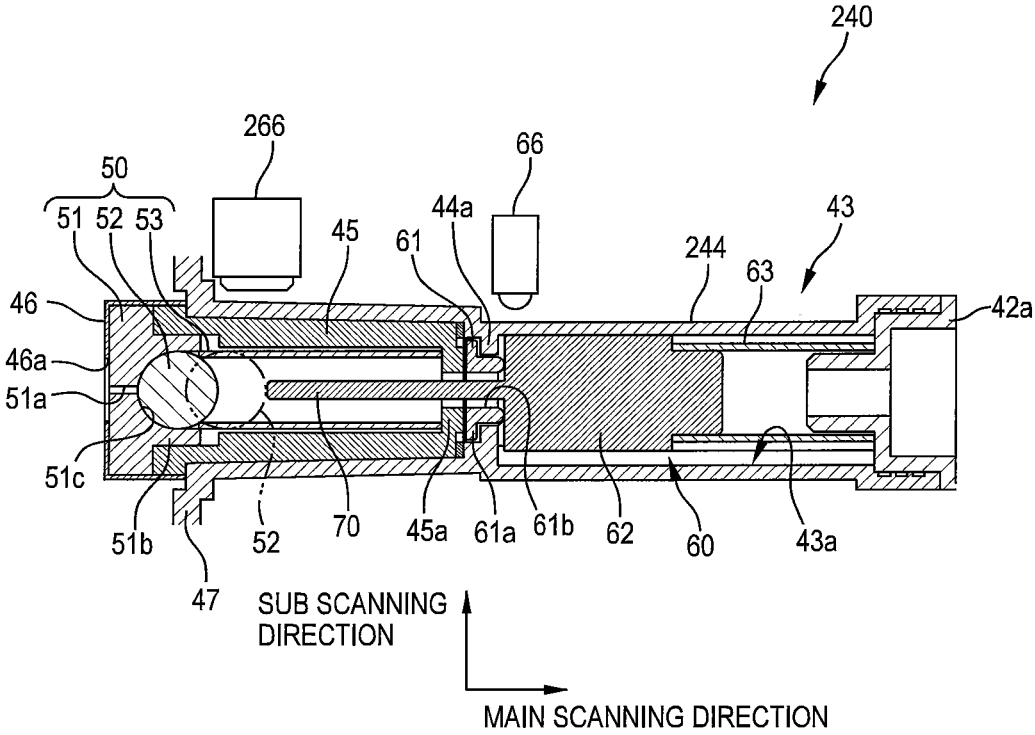
FIG. 11 is a partial cross-sectional view of an ink cartridge according to a second embodiment of the present invention.

As shown in FIG. 11, the photosensor 266 is disposed in a position so as not to oppose the spherical member 52 when the spherical member 52 is in contact with the annular protrusion 51*b* and so as to oppose the spherical member 52 when the spherical member 52 has separated from the annular protrusion 51*b*, as depicted by the dashed line. When the spherical member 52 is positioned opposite the photosensor 266, the photosensor 266 outputs a signal indicating that the light-receiving element has received light (hereinafter referred to as signal E). However, when the spherical member 52 is not positioned opposite the photosensor 266, the photosensor 266 outputs a signal indicating that the light-receiving element does not receive reflected light (hereinafter referred to as signal F). These signals are transmitted to the controller 100 via the controller 90. Upon receiving the signals, the controller 100 can distinguish when the first valve 50 is in the open state and the closed state. In the embodiment, the controller 100 detects that the first valve 50 is in the open state when receiving the signal E indicating that the light-receiving element has received light and detects that the first valve 50 is in the closed state when receiving the signal F indicating that the light-receiving element is not receiving light.

Next, operations performed by the controller 100 of the inkjet printer 1 and the controller 90 of the ink cartridge 240 when an ink cartridge 240 is being mounted into the printer body will be described with reference to the flowchart in FIG. 10. As in the first embodiment described above, the ink cartridges 240 according to the second embodiment are mounted into respective mounting units 150. Here, the controller 100 performs the same processes described in S1-S4 of the first embodiment. By the time the first valve 50 shifts to the open state, the contact point 91 and contact point 161 become electrically connected and the contact point 163 of the power output part 162 and the power input unit 92 become electrically connected, enabling the two controllers 90 and 100 to be electrically connected to each other and to exchange signals and enabling power to be supplied to the controller 90 and the photosensors 66 and 266. Hence, in S2 the controller 100 may determine whether the time elapsed after the signal E was received from the photosensor 266 until the signal B was received from the photosensor 66 exceeds the mounting time limit as a variation of the second embodiment. In this case, the mounting time limit is previously adjusted appropriately for this determination. Further, the controller 90 may be configured to execute the process in S2 by storing this mounting time limit in the storage unit 125. The controller 90 may also be configured to determine in S4 whether the second valve 60 is in the open state. In this case, the controller 90 may not output a signal to the controller 100 indicating that the second valve 60 is in the open state. As in the first embodiment, the determination in S4 in the second embodiment also serves for determining whether the hollow needle 153 was properly inserted into the ink cartridge 40.

In S5 the controller 90 of the ink cartridge 240 calculates the mounting time elapsed between the moment that the signal E was received from the photosensor 266 and the moment that the signal B was received from the photosensor 66. The remaining process is identical to the process described in the first embodiment for steps S6-S14. Since one factor described in the first embodiment for calculating the mounting time, i.e., the moment at which the signal C is received from the sensor 170 is changed to the moment at which the signal E is received from the photosensor 266 (i.e., the moment that the first valve 50 changes from the closed state to the open state), the data in Table 1 should be adjusted appropriately.

Next, the operations performed when an ink cartridge 240 is removed from the printer body will be described. As the ink cartridge 240 moves out of the printer body in the second embodiment, the spherical member 52, valve member 62, and pressing member 70 move leftward in FIG. 11 by the urging forces of the coil springs 53 and 63 while remaining in contact with each other. That is, the spherical member 52, pressing member 70, and valve member 62 operate in reverse to that when the hollow needle 153 is inserted. Thus, the valve member 62 contacts the valve seat 61, shifting the second valve 60 from the open state to the closed state. At this time, the signal outputted from the photosensor 66 to the controller 90 changes from signal B to signal A, and the controller 90 detects that the second valve 60 is in the closed state. Subsequently, when the spherical member 52 contacts the annular protrusion 51*b*, i.e., when the first valve 50 changes from the open state to the closed state, the signal outputted from the photosensor 266 to the controller 90 changes from signal E to signal F and the controller 90 detects that the first valve 50 is in the closed state.

After the hollow needle 153 is extracted from the sealing member 51, the contact point 91 and contact point 161 are disconnected and the power input unit 92 and contact point 163 are disconnected as the ink cartridge 240 continues to be removed. When the case 41 separates from the detecting part 171 so that the detecting part 171 protrudes out from the sensor 170, the sensor 170 outputs the signal D to the controller 100, by which signal the controller 100 can determine that the ink cartridge 240 has been removed from the printer body. Thereafter, as described in the first embodiment, the operator replaces the ink cartridge 240 that was removed from the printer body with a new ink cartridge 240, mounting the new ink cartridge 240 in the printer body according to the procedure described above.

With the inkjet printer 1 according to the second embodiment described above, the controller 90 calculates the mounting time for an ink cartridge 240 when the ink cartridge 240 is mounted in its corresponding mounting unit 150 to determine whether maintenance is required. Hence, the inkjet printer 1 according to the second embodiment can obtain the same effects described in the first embodiment. Further, by providing the photosensor 266 for detecting when the first valve 50 is in an open or closed state, the controller 90 can calculate the mounting time more accurately than in the first embodiment as the reception time difference between signals received from the photosensors 66 and 266 indicating the open states of the first and second valves 50 and 60, respectively, because the moving distance of the ink cartridge 240 used to calculate the mounting time is short. By reducing the moving distance (predetermined distance) used in the calculation, the calculation is less likely to be influenced by human error introduced by the user mounting the cartridge, that is, the user's induced problem that the mounting speed varies while the ink cartridge is being mounted, thereby resulting in a more accurate calculation of the mounting speed, more specifically, the mounting speed around the time when the second valve 60 opens to communicate the ink cartridge 240 with the ink supply channel 154. In the embodiment, the sensor 170 may be eliminated since the mounting time is computed based on the timings at which the first and second valves 50 and 60 change to their open states.

As a variation of the second embodiment, the annular protrusion 51*b* could be elongated in the main scanning direction, for example, so that the first valve 50 becomes open after the second valve 60 opens when the ink cartridge 240 is mounted in the mounting unit 150. Thus, the mounting time could be calculated as the time between the moment that the first valve 50 switches to the open state and the moment that the second valve 60 switches to the open state. In this way, this variation can obtain the same effects described in the first and second embodiments.

In a variation of the first and second embodiments, the controller 100 may be used in place of the controller 90 to perform the same control operations as the controller 90. Hence, the controller 100 could perform the control processes in S5-S7, S9, and S11 in place of the controller 90. In this case, the controller 90 may be eliminated from the ink cartridge 40, despite which the same effects described in the first and second embodiments can be obtained.

As another variation of the embodiments, the storage unit 125 may be provided in the printer body rather than in the ink cartridge 40 and ink cartridge 240. Further, the storage unit 125 may store different prescribed times (threshold times for determining whether maintenance is required) in association with different types of printer bodies in which the ink cartridge 40 or 240 can be used, or coefficients for multiplying the pre-stored prescribed times. More specifically, the storage unit 125 may store separate prescribed times that are shorter than reference times or a coefficient that can be used to shorten the reference times through multiplication when the length of the ink channel from the hollow needle 153 to the ejection holes formed in the inkjet head 2 is longer than a reference distance, and may store separate prescribed times longer than the reference times or a coefficient for lengthening the reference times when the ink channel is shorter than the reference distance. Further, the separate prescribed times or coefficients may be associated with the pressure resistance of the ink meniscus rather than the length of the ink channel. Specifically, the storage unit 125 could store separate prescribed times that are shorter than the reference times or a coefficient for reducing the reference times through multiplication when the ejection openings in the inkjet head 2 have a greater diameter than a reference diameter (a smaller meniscus pressure resistance than the reference pressure resistance), and separate prescribed times longer than the reference times or a coefficient for increasing the reference times when the diameter of the ejection openings is smaller than the reference diameter. Here, a controller may be suitably used to identify the type of printer and, based on the printer type, to select either the reference times or separate prescribed times, or to calculate and apply new prescribed times by multiplying the reference times by a coefficient. In addition, the storage unit 125 may store separate quantities of ink leakage associated with different printer types or coefficients for multiplying pre-stored quantities of ink leakage.

Third Embodiment

An inkjet printer 300 (recording device) and an ink cartridge 340 according to a third embodiment of the present invention will be described with reference to FIGS. 12-13.

In the inkjet printer 1 of the first embodiment, each ink cartridge 40 is directly connected to the corresponding inkjet head 2 via the tube 102.

However, according to the inkjet printer 300 of the present embodiment, a subsidiary tank 310 is provided between each ink cartridge 40 and the corresponding inkjet head 2. The subsidiary tank 310 is for separating air from ink and for establishing a pressure head difference between the subsidiary tank 310 and the inkjet head 2.

The inkjet printer 300 of the present embodiment is the same as the inkjet printer 1 of the first embodiment except that the inkjet printer 300 is provided with ink supply systems described below and that the inkjet printer 300 operates as described below. The ink cartridge 340 of the present embodiment is the same as the ink cartridge 40 of the first embodiment except that a Table 2 to be described later is stored in the storing unit 125 instead of the Table 1. Components in the inkjet printer 300 and the ink cartridge 340 the same as those of the first embodiment are designated with the same reference numerals to avoid duplicating description.

Next, the ink supply systems for the inkjet printer 300 will be described with reference to FIG. 12.

Similarly to the first embodiment, four ink supplying systems are provided for the four inkjet print heads 2, respectively. The ink supplying systems have the same configurations with one another. One of the ink supplying systems will be described below while referring to FIG. 12, but the following description is in common to the other ink supplying systems.

Figure 12:
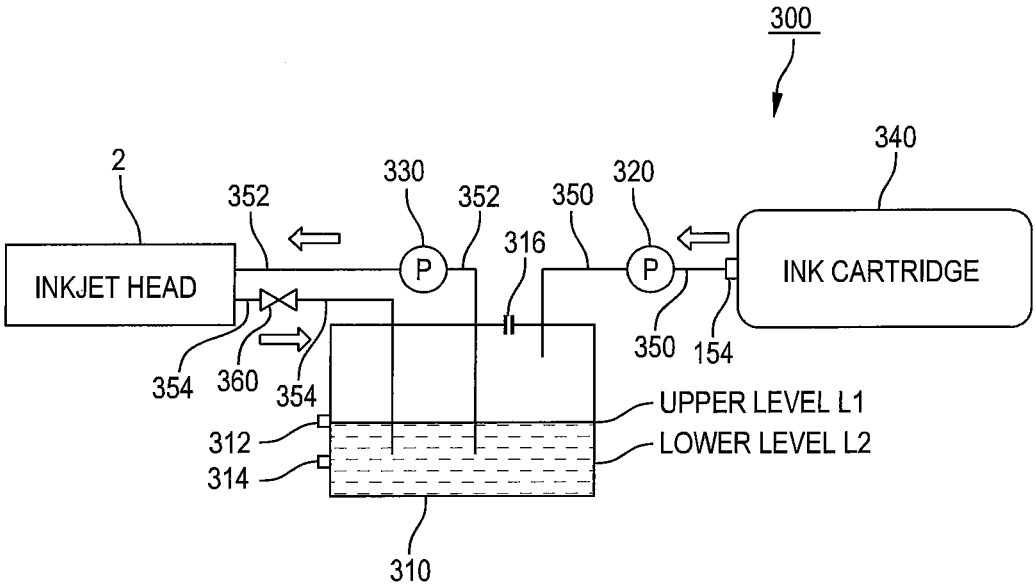
FIG. 12 is a schematic diagram showing an ink supplying system of an inkjet printer according to a third embodiment of the present invention.

As shown in FIG. 12, one subsidiary tank 310 is provided for each inkjet head 2.

In each ink supplying system, one inkjet head 2 is connected via a flexible tube 352 (ink supplying path) to one subsidiary tank 310. A purge/circulation pump 330 (ink discharging unit, ink forcibly supplying unit) is provided in the midway portion of the tube 352 connecting the inkjet head 2 and the subsidiary tank 310. The inkjet head 2 is connected also via a flexible tube 354 to the subsidiary tank 310. An open/close valve 360 is provided in the midway portion of the tube 354 connecting the inkjet head 2 and the subsidiary tank 310. The subsidiary tank 310 is connected via a flexible tube 350 (ink supplying path) to one ink supply channel 154. An ink supply pump 320 is provided in the midway portion of the tube 350 connecting the subsidiary tank 310 and the ink supply channel 154. When one ink cartridge 340 is mounted in the body of the printer 300 (the casing 1*a*), the ink cartridge 340 is connected to one ink supply channel 154 so that ink can be supplied from the ink cartridge 340 via the corresponding subsidiary tank 310 to the corresponding inkjet head 2. The ink supply pump 320 is for supplying ink from the ink cartridge 340 to the subsidiary tank 310. The purge/circulation pump 330 is for forcibly supplying ink from the subsidiary tank 300 to the inkjet head 2, thereby discharging ink from the subsidiary tank 300. The purge/circulation pump 330 is also for circulating ink between the subsidiary tank 310 and the inkjet head 2. The open/close valve 360 is closed when ink is discharged from the subsidiary tank 310 through the inkjet head 2. The open/close valve 360 is opened when ink is circulated between the subsidiary tank 310 and the inkjet head 2.

The subsidiary tank 310 is formed with an opening 316. The interior of the subsidiary tank 310 is in fluid communication with atmospheric air through the opening 316. Air is separated from ink when the ink is introduced into the subsidiary tank 310. A pressure head difference within a desired range can be generated between ink in the inkjet head 2 and ink in the subsidiary tank 310 if the level of the liquid surface of the ink stored in the subsidiary tank 310 is within a predetermined range in the vertical direction, that is, if the level of the liquid surface of the ink is between a predetermined upper level L1 and a predetermined lower level L2 shown in FIG. 12. According to the present embodiment, the controller 100 performs a control operation to maintain the level of the liquid surface of the ink within the subsidiary tank 310 at the upper level L1. The controller 100 further performs a control operation to control the liquid surface of the ink not to fall below the lower level L2 during a printing process.

The subsidiary tank 310 is provided with an upper sensor 312 and a lower sensor 314, both of which are for detecting the liquid surface of ink in the subsidiary tank 310. The upper sensor 312 and a lower sensor 314 are provided at the locations corresponding to the upper level L1 and the lower level L2, respectively. The upper sensor 312 outputs an ON signal when the liquid surface of ink is at the same level with or at the higher level than the upper level L1. The upper sensor 312 outputs an OFF signal when the liquid surface of ink is at the lower level than the upper level L1. The lower sensor 314 outputs an ON signal when the liquid surface of ink is at the same level with or at the higher level than the lower level L2. The lower sensor 314 outputs an OFF signal when the liquid surface of ink is at the lower level than the lower level L2. The controller 100 is configured to receive those signals outputted from the upper sensor 312 and the lower sensor 314.

At the initial stage where ink is not yet supplied to the subsidiary tank 310, the controller 100 drives the ink supply pump 320 to supply ink from the ink cartridge 340 to the subsidiary tank 310. As ink is supplied to the subsidiary tank 310, the output signal from the lower sensor 314 switches from the OFF state to the ON state before the output signal from the upper sensor 312 switches from the OFF state to the ON state. When the output signal from the upper sensor 312 switches to the ON state, the controller 100 stops driving the ink supply pump 320.

The controller 100 can perform an ink discharging operation (purge operation) to forcibly eject ink from the subsidiary tank 310 through the ejecting surface 2*a* of the inkjet head 2, by driving the purge/circulation pump 330 while maintaining the open/close valve 360 in the closed state. It is noted that before performing the ink discharging operation, similarly to the maintenance process in the first embodiment, the inkjet heads 2 are moved to the retracted position and the caps 31 are moved to the capping position. According to the present embodiment, the purge/circulation pump 330 is included in the maintenance mechanism 30.

The controller 100 can also perform an ink circulating operation, by driving the purge/circulation pump 330 while opening the open/close valve 360. With this ink circulating operation, air bubbles accumulated in the ink channels in the inkjet head 2 can be discharged.

During the printing process, the controller 100 does not drive the ink supply pump 320 or the purge/circulation pump 330. When ink is ejected from the ejection surface 2*a* of the inkjet head 2 to perform printing operation, ink of the same amount with the ejected ink is drawn into the inkjet head 2 from the subsidiary tank 310 due to a capillary force. The controller 100 continuously checks the output signals from the upper sensor 312 and the lower sensor 314 during the printing process. As ink in the subsidiary tank 310 is consumed, the output signal from the upper sensor 312 switches from ON to OFF, before the output signal from the lower sensor 314 switches from ON to OFF. When the output signal from the lower sensor 314 switches from ON to OFF, the controller 100 starts driving the ink supply pump 320 to supply ink from the ink cartridge 340 to the subsidiary tank 310. When the output signal from the upper sensor 312 switches from OFF back to ON, the controller 100 stops driving the ink supply pump 320.

With the above described control, the liquid surface of ink in the subsidiary tank 310 is usually maintained at the upper level L1. During the printing process, the liquid surface of ink in the subsidiary tank 310 is maintained between the upper level L1 and the lower level L2.

When the ink cartridge 340 is mounted in the mounting unit 150, if the mounting speed is high, ink happens to flow from the ink cartridge 340 into the subsidiary tank 310. The liquid surface of ink in the subsidiary tank 310 will possibly rise and exceed the upper level L1, and therefore go beyond the range between the upper level L1 and the lower level L2.

Considering this problem, according to the present embodiment, the storing unit 125 provided in the ink cartridge 340 stores data of the Table 2 shown below instead of the Table 1. Similarly to Table 1, Table 2 stores data in correspondence with each of combinations of: four time ranges T1, T2, T3, and T4 for the mounting time of the ink cartridge 340 and four ink volume ranges V1, V2, V3, and V4 for the ink cartridge 340. Data for each combination of the time range and the ink volume range indicates the amount of ink flowing from the ink cartridge 340 to the subsidiary tank 310 (the amount of ink flowing out of the ink accommodating unit) and whether ink has to be discharged from the subsidiary tank 310 through the inkjet head 2 (whether or not it is necessary to perform ink forcibly ejecting operation to forcibly eject ink from a recording head).

The concrete values of the time ranges T1, T2, T3, and T4 are the same as those in the first embodiment. That is, T1 is set to a range greater than or equal to 0 seconds and less than 0.5 seconds, time range T2 to a range greater than or, equal to 0.5 seconds and less than 1.5 seconds, time range T3 to a range greater than or equal to 1.5 seconds and less than 2.5 seconds, and time range T4 to a range greater than or equal to 2.5 seconds. Similarly, the concrete values of the ink volume ranges V1, V2, V3, V4 are the same as those in the first embodiment. That is, ink volume range V1 is set to a range greater than or equal to 0 ml and less than 500 ml, ink volume range V2 to a range greater than or equal to 500 ml and less than 700 ml, ink volume range V3 to a range greater than or equal to 700 ml and less than 800 ml, and ink volume range V4 to a range greater than or equal to 800 ml and less than 1,000 ml.

TABLE 2

| | | Ink volume range | | | |
|---|---|---|---|---|---|
| | | V1 | V2 | V3 | V4 |
| Time range | T1 | Ink discharging operation not required<br>No ink inflow occurs | Ink discharging operation required<br>ink inflow occurs (ink of almost 0 ml) | Ink discharging operation required<br>ink inflow occurs (very slight amount of ink) | Ink discharging operation required<br>ink inflow occurs (some ink) |
| | T2 | Ink discharging operation not required<br>No ink inflow occurs | Ink discharging operation not required<br>No ink inflow occurs | Ink discharging operation required<br>ink inflow occurs (ink of almost 0 ml) | Ink discharging operation required<br>ink inflow occurs (very slight amount of ink) |
| | T3 | Ink discharging operation not required<br>No ink inflow occurs | Ink discharging operation not required<br>No ink inflow occurs | Ink discharging operation not required<br>No ink inflow occurs | Ink discharging operation required<br>ink inflow occurs (ink of almost 0 ml) |
| | T4 | Ink discharging operation not required<br>No ink inflow occurs | | | |

Hence, for the case where the mounted ink cartridge 340 has an ink volume falling within ink volume range V1, the Table 2 indicates that no ink inflow occurs and that an ink discharging operation is not necessary, regardless of which time range T1-T3 corresponds to the mounting time. Here, the mounting time indicates the time elapsed between the moment that the ink cartridge 340 was beginning to be mounted in the mounting unit 150 and the moment that the second valve 60 in the ink cartridge 340 switched from the closed state to the open state.

For the case where the mounted ink cartridge 340 has an ink volume that falls within ink volume range V2, the Table 2 indicates that ink inflow with an amount of almost zero (0) ml occurs and an ink discharging operation is necessary only when the mounting time falls within time range T1. In other words, the Table 2 indicates that a small amount of ink may possibly flow into the subsidiary tank 310 and an ink discharging operation is necessary when the mounting time is less than 0.5 seconds. Thus, 0.5 seconds is the threshold for indicating whether or not an ink discharging operation will be required.

For the case where the mounted ink cartridge 340 has an ink volume that falls within ink volume range V3 and the mounting time falls within time range T1, the Table 2 indicates that a very slight amount of ink flows into the subsidiary tank 310 (approximately 1 ml, for example) and that an ink discharging operation is necessary. For the case where the mounted ink cartridge 340 has an ink volume that falls within ink volume range V3 and the mounting time falls within time range T2, the Table 2 indicates that ink of almost zero (0) ml flows into the subsidiary tank 310 and that an ink discharging operation is necessary. In other words, an ink discharging operation is required when the ink volume of the mounted ink cartridge 340 falls within ink volume range V3 and the mounting time is less than 1.5 seconds, but unnecessary if the mounting time is longer.

For the case where the mounted ink cartridge 340 has an ink volume that falls within ink volume range V4, the Table 2 indicates that an ink discharging operation is necessary, regardless of which time range T1-T3 corresponds to the mounting time. The Table 2 also indicates that a small amount of ink flows into the subsidiary tank 310 (about 3 ml, for example) when the mounting time falls within time range T1, that a very slight amount of ink flows into the subsidiary tank 310 when the mounting time falls within time range T2, and that ink of almost zero (0) ml flows into the subsidiary tank 310 when the mounting time falls within time range T3.

The Table 2 further indicates that ink does not flow into the subsidiary tank 310 and an ink discharging operation is unnecessary when the mounting time is greater than 2.5 seconds, that is, when the mounting time falls in a time range T4, if the volume of ink in the ink cartridge 340 is less than 1,000 ml.

In this way, similarly to the Table 1 in the first embodiment, the Table 2 stores data specifying prescribed threshold times (0, 0.5, 1.5, and 2.5 seconds) corresponding to the respective ink volume ranges V1-V4 for which an ink discharging operation becomes necessary.

A manufacturer of the ink cartridge 340 creates the Table 2 by performing an experiment. During the experiment, the manufacturer prepares a plurality of ink cartridges 340 that are filled with ink of various volumes. The manufacturer mounts the ink cartridges 340 in the mounting unit 150 of the inkjet printer 300 at various speeds. The manufacturer measures the amount of ink flowing from each ink cartridge 340 to the subsidiary tank 310.

Figure 13:
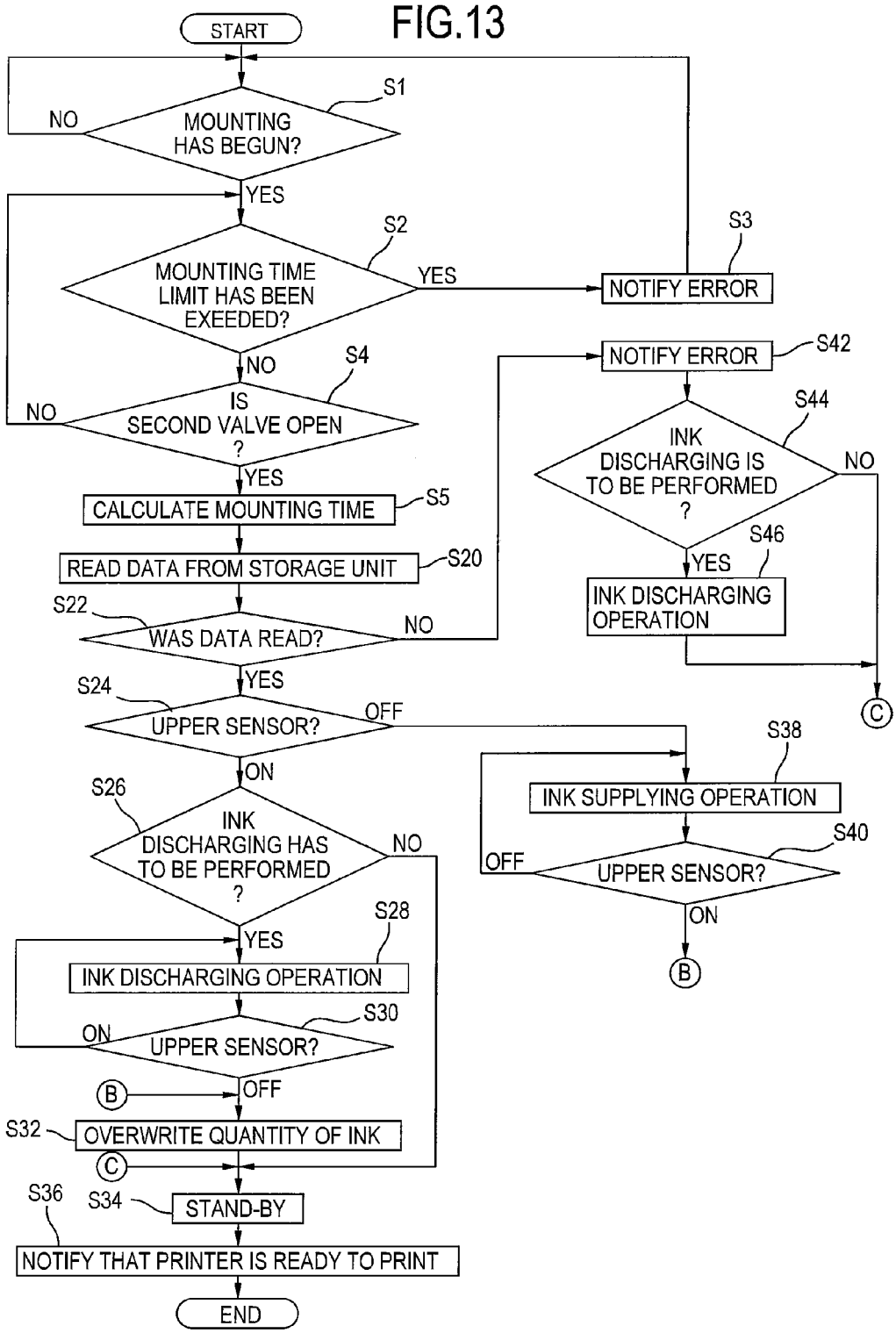
FIG. 13 is a flowchart illustrating steps in a control process performed by controllers in the inkjet printer and the ink cartridge according to the third embodiment when the ink cartridge is mounted in the mounting unit of the printer.

The controller 100 of the inkjet printer 300 and the controller 90 of the ink cartridge 340 execute operations as shown in FIG. 13 instead of the operations shown in FIG. 10 when an ink cartridge 340 is mounted in the mounting unit 150.

In the flowchart of FIG. 13, the processes of S1-S5 are the same as those of S1-S5 in FIG. 10.

After calculating the mounting time in S5, in S20, the controller 90 reads out data of the current ink volume and data of the Table 2 stored in the storage unit 125. Next in S22, the controller 90 determines whether data was read from the storage unit 125 in S20. The process proceeds from S22 to S24 if the controller 90 determines that data was successfully read from the storage unit 125.

In S24, the controller 100 checks whether the output signal from the upper sensor 312 is ON or OFF.

If the output signal from the upper sensor 312 is ON (ON in S24), the controller 100 informs the controller 90 that the upper sensor 312 is ON. In S26, the controller 90 determines within which of the time ranges T1, T2, T3, and T4 the mounting time calculated in S5 falls, determines within which of the ink volume ranges V1, V2, V3, and V4 the volume of ink in the mounted ink cartridge 340 falls, and determines whether an ink discharging operation has to be performed for the newly mounted ink cartridge 340 by referring to the Table 2.

If the controller 90 determines that an ink discharging operation is required (S26: YES), in S28 the controller 90 outputs a signal to the controller 100 requesting that an ink discharging operation be started. Upon receiving this signal, the controller 100 performs the ink discharging operation by driving the purge/circulation pump 330 for a predetermined period of time while the open/close valve 360 is in the closed state. It is noted that the controller 100 starts driving the purge/circulation pump 330 after moving the inkjet heads 2 to the retracted position and moving the caps 31 to the capping position, similarly to S10 in the first embodiment. In this way, ink is discharged from the subsidiary tank 310 via the inkjet head 2.

Next, in S30, the controller 100 checks whether the output signal from the upper sensor 312 turns from ON to OFF. If the output signal from the upper sensor 312 maintains ON (ON in S30), the process returns to S28, and the controller 100 continues the ink discharging operation. When the output signal from the upper sensor 312 turns from ON to OFF (OFF in S30), it is known that the liquid surface of ink in the subsidiary tank 310 has declined to reach the upper level L1. So, the controller 100 stops driving the purge/circulation pump 330, returns the caps 31 to the initial position and returns the inkjet heads 2 to the printing position, and notifies the controller 90 that the ink discharging operation is complete. Then, the process proceeds to S32.

Upon receiving notification that the ink discharging operation was complete, in S32, the controller 90 overwrites the quantity of ink stored in the storage unit 125. More specifically, the controller 90 first determines whether the ink inflow amount is "ink of almost 0 ml," a "very slight amount of ink," or "some ink," by referring to the Table 2, subtracts this determined quantity of flowing ink from the quantity of ink stored in the storage unit 125, and updates the ink quantity in the storage unit 125 with the result. Next, the process advances to S34 and enters a standby state, i.e., a print-ready state.

Next, in S36 the controller 90 outputs a signal to the controller 100 indicating that the ink cartridge 340 is print-ready. After receiving this signal, the controller 100 controls the buzzer 13 to emit a sound for notifying the user that the printer 300 is ready to print, and the operation for mounting the ink cartridge 340 is complete. The operation for updating the ink quantity of the ink cartridge 340 described in S32 may instead be performed after the operation in S36 and before the controller 100 begins a printing operation.

On the other hand, if it is determined in S26 that an ink discharging operation is not necessary (no in S26), the process proceeds from S26 directly to S34.

If the output from the upper sensor 312 is OFF in S24 (OFF in S24), the process proceeds to S38. In S38, the controller 100 drives the ink supply pump 320 to supply ink from the ink cartridge 340 to the subsidiary tank 310. Next, in S40, the controller 100 checks whether the output from the upper sensor 312 turns ON. If the output from the upper sensor 312 maintains OFF (OFF in S40), the process returns to S38, and the controller 100 continues the ink supplying operation. When the output from the upper sensor 312 turns ON (ON in S40), the controller 100 stops driving the ink supply pump 320, notifies the controller 90 that the ink supply is complete, and the process proceeds to S32.

When executing the process of S32 upon receiving notification that ink supply is complete, the controller 90 overwrites the quantity of ink stored in the storage unit 125 by subtracting the quantity of ink expended in the ink supplying operation from the quantity of ink stored in the storage unit 125, and updates the ink quantity in the storage unit 125 with the result.

On the other hand, if the controller 90 was unable to read data because the data is not stored in the storage unit 125 (S22: NO), then the controller 90 outputs an error signal to the controller 100 and, upon receiving this error signal, the controller 100 controls the buzzer 13 in S42 to emit a sound alerting the user of a problem with the storage unit 125. Then, the process proceeds from S42 to S44.

In S44, the controller 100 controls the buzzer 13 to emit a sound asking the user whether to or not to perform an ink discharging operation. If the user inputs, to the manipulation unit (not shown), his/her instruction to perform an ink discharging operation (yes in S44), the process proceeds to S46, in which an ink discharging operation is executed in the same manner as in S28. Then, the process proceeds to S34. If the user inputs his/her instruction not to perform an ink discharging operation (no in S44), the process proceeds from S44 directly to S34.

With the above-described configuration, if the ink cartridge 340 is mounted in the mounting unit 150 at a high speed and therefore ink flows from the ink cartridge 340 into the subsidiary tank 310 and the liquid surface level of the ink in the subsidiary tank 310 exceeds the upper level L1, the ink discharging operation is executed to discharge ink from the subsidiary tank 310 to return the liquid surface level back to the upper level L1. So, the negative pressure applied to the ink within the nozzles in the inkjet head 2 can be maintained in the desired range. So, the inkjet head 2 can maintain desirable ink ejection characteristics. The ink discharging operation is not executed when the ink cartridge 340 is mounted at a low speed. So, ink is not consumed in vain.

<Modifications>

The inkjet printer 300 of the third embodiment can be modified so that the ink cartridge 240 of the second embodiment can be mounted therein. More specifically, the flowchart of FIG. 13 is modified so that in S5 the controller 90 of the ink cartridge 240 calculates the mounting time elapsed between the moment that the signal E was received from the photosensor 266 and the moment that the signal B was received from the photosensor 66. The ink cartridge 240 is modified so that the storage unit 125 of the ink cartridge 240 stores data of Table 2 instead of Table 1. It is noted that data in Table 2 should be adjusted appropriately since one factor for calculating the mounting time, i.e., the moment at which the signal C is received from the sensor 170 is changed to the moment at which the signal E is received from the photosensor 266.

In a variation of the third embodiment, the controller 100 may be used in place of the controller 90 to perform the same control operations as the controller 90. Hence, the controller 100 could perform the control processes in S5-S22, S26, and S32 in place of the controller 90. In this case, the controller 90 may be eliminated from the ink cartridge 340, despite which the same effects described in the third embodiment can be obtained.

As another variation of the present embodiment, the storage unit 125 may be provided in the printer body rather than in the ink cartridge 340. Further, the storage unit 125 may store different prescribed times (threshold times for determining whether an ink discharging operation is required) in association with different types of printer bodies in which the ink cartridge 340 can be used, or coefficients for multiplying the pre-stored prescribed times. More specifically, the storage unit 125 may store separate prescribed times that are shorter than reference times or a coefficient that can be used to shorten the reference times through multiplication when the length of the ink channel from the hollow needle 153 to the subsidiary tank 310 is longer than a reference distance, and may store separate prescribed times or a coefficient for lengthening the reference times when the ink channel is shorter than the reference distance. Here, a controller may be suitably used to identify the type of printer and, based on the printer type, to select either the reference times or separate prescribed times, or to calculate and apply new prescribed times by multiplying the reference times by a coefficient. In addition, the storage unit 125 may store separate ink flowing quantities associated with different printer types or coefficients for multiplying pre-stored ink flowing quantities.

In addition, the various variations for the ink cartridge 40 of the first embodiment can be applied in a similar manner to the ink cartridge 340 of the third embodiment.

While the invention has been described in detail with reference to specific embodiments thereof, it would be apparent to those skilled in the art that many modifications and variations may be made therein without departing from the spirit of the invention, the scope of which is defined by the attached claims.

For example, the pressing member 70 may be integrally formed with the spherical member 52. The pressing member 70 may be integrally formed with both of the spherical member 52 and the valve member 62. Alternatively, the pressing member 70 may be provided separately and not integrally formed with the spherical member 52 or valve member 62. As another variation, the first valve 50 may be configured as merely a sealing member for sealing the opening formed in the end of the tube 45. In this case, the hollow needle 153, per se. will press the pressing member 70. Also in this case, it is not necessary to form the slit 51*a* in the sealing member 51. In this case, the hollow needle 153 will penetrate the sealing member 51 to open the first valve 50.

The first valve may have a structure different from that described in the embodiments, provided that the first valve is disposed in the ink delivery tube and can be selectively moved between an open state for allowing communication in the ink delivery tube and a closed state for interrupting communication in the ink delivery tube.

The second valve may also have a different structure than that described in the embodiments, provided that the second valve is disposed in the ink delivery tube between the ink bag and the first valve and can be selectively changed between an open state for allowing communication in a channel of the ink delivery tube extending from the ink bag to the first valve and a closed state for interrupting communication along this channel based on the insertion of the hollow needle 153.

Alternatively, a movable member may be provided in place of the second valve, whereby the movable member is urged by an urging member so that movement of the movable member is restricted to a prescribed range, and the photosensor 66 may be configured to detect the position of the movable member. This configuration requires that the first valve have greater integrity so that ink does not leak therefrom.

Further, sensors other than the photosensors 66 and 266 described in the embodiments may be used to detect the open and closed states of the first and second valves 50 and 60.

The casing 1*a* may also be provided with a display for providing notifications to the user in place of the buzzer 13 by displaying images rather than emitting sound. Alternatively, both notification devices (the buzzer and display) may be used in concert.

Figure 14:
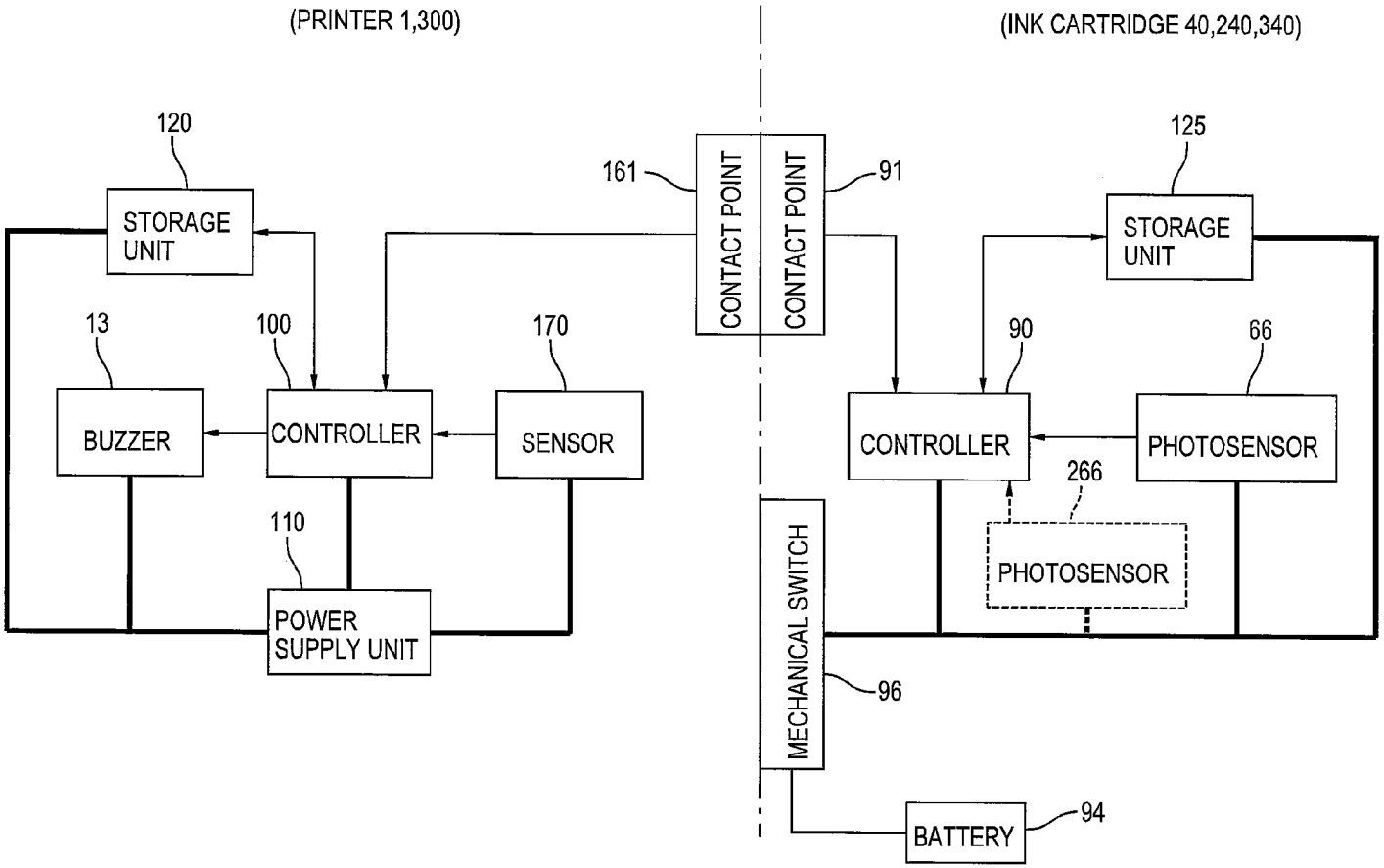
FIG. 14 is a block diagram showing the electrical structure of an inkjet printer and an ink cartridge according to a modification.

In the first through third embodiments described above, power is supplied to internal components of the ink cartridge (the photosensors 66, 266, controller 90, etc.) by mounting the ink cartridge in the printer body. However, as shown in FIG. 14, a battery 94 may be provided in the ink cartridge in place of the power input unit 92 and a mechanical switch 96 may be provided in the ink cartridge for regulating the supply of power from the battery 94 to the components. In this case, the mechanical switch 96 contacts the surface of a wall forming the recessed part 151 of the mounting unit 150 when the ink cartridge is mounted in the mounting unit 150, enabling the supply of power from the battery 94 to the internal components of the ink cartridge. This supply of power to the internal components is halted when the mechanical switch 96 separates from the wall surface. It is preferable that the mechanical switch 96 be configured such that power is supplied from the battery 94 to the internal components of the ink cartridge at the same timing that the power input unit 92 and power output part 162 become electrically connected. In this way, the same effects described in the first through third embodiments can be obtained.

What is claimed is:

1. An ink cartridge, comprising:

an ink accommodating unit that is configured to accommodate ink therein; and a storing unit that is configured to store time length data indicative of a length of time to be taken by the ink cartridge to move from a first position to a second position different from the first position, the first position and the second position being defined within a mounting unit in a recording device, the ink cartridge reaching the first position before reaching the second position when the ink cartridge is mounted in the mounting unit.

2. The ink cartridge as claimed in claim 1, wherein the length of time is defined dependently on an amount of ink accommodated in the ink accommodating unit.

3. The ink cartridge as claimed in claim 1, further comprising a detecting unit that is configured to detect that the ink cartridge is located at the second position.

4. The ink cartridge as claimed in claim 3, further comprising:

an ink delivery path that is in fluid communication with the ink accommodating unit; and a valve that is provided in the ink delivery path and that is configured so as to be capable of being switched between an opened state and a closed state;

wherein the detecting unit detects that the valve is switched from the closed state to the opened state.

5. The ink cartridge as claimed in claim 1, further comprising:

a first detecting unit that is configured to detect that the ink cartridge is located at the first position; and a second detecting unit that is configured to detect that the ink cartridge is located at the second position.

6. The ink cartridge as claimed in claim 5, further comprising:

an ink delivery path that is in fluid communication with the ink accommodating unit at one end and that has an ink delivery opening at another end;

a first valve that is provided in the another end of the ink delivery path and that is configured so as to be capable of being switched between an opened state and a closed state; and a second valve that is provided in the ink delivery path at a location between the one end and the another end and that is configured so as to be capable of being switched between an opened state and a closed state;

wherein the first detecting unit detects that the first valve is switched from the closed state to the opened state, and the second detecting unit detects that the second valve is switched from the closed state to the opened state.

7. A recording device, comprising:

a recording head that is configured so as to eject ink therefrom;

an ink cartridge that has an ink accommodating unit that is configured to accommodate ink therein;

a mounting unit, in which the ink cartridge is mounted;

a storing unit that is configured to store time length data indicative of a length of time to be taken by the ink cartridge to move from a first position to a second position different from the first position, the first position and the second position being defined within the mounting unit, the ink cartridge reaching the first position before reaching the second position when the ink cartridge is mounted in the mounting unit;

a first detecting unit that is configured to output a first detection signal upon detecting that the ink cartridge is located at the first position;

a second detecting unit that is configured to output a second detection signal upon detecting that the ink cartridge is located at the second position;

a calculating unit that calculates a length of time taken by the ink cartridge to move from the first position to the second position based on the first detection signal and the second detection signal;

a comparing unit that compares the calculated length of time with the length of time indicated by the time length data;

an ink discharging unit that is configured to forcibly eject ink from the recording head; and a control unit that controls the ink discharging unit based on a comparing result by the comparing unit.

8. A recording device as claimed in claim 7, wherein the ink cartridge further comprises:

an ink delivery path that is in fluid communication with the ink accommodating unit at one end and that has an ink delivery opening at another end; and a moving body that is provided movable in the ink delivery path, the moving body being configured so as to be movable by being pushed by a hollow tube, the hollow tube being configured to enter the ink delivery path from the ink delivery opening to take up ink, wherein the first detecting unit is provided within the mounting unit and is configured to detect that the ink cartridge is located at the first position by contacting the ink cartridge that is being mounted in the mounting unit, and wherein the second detecting unit is provided within the ink cartridge and is configured to detect that the moving body is located at a predetermined position within the ink delivery path.

9. A recording device as claimed in claim 7, wherein the storing unit further stores ink amount data indicative of an amount of ink stored in the ink accommodating unit, wherein the recording device further comprises an overwriting unit that overwrites the ink amount data based on an amount of ink expended from the ink accommodating unit, wherein the storing unit stores a plurality of sets of time length data in accordance with a plurality of different ink amount ranges, and wherein the comparing unit compares the calculated length of time with a time length indicated by one set of time length data that corresponds to an ink amount range, in which an ink amount indicated by the ink amount data falls.

10. A recording device as claimed in claim 7, further comprising an ink supplying path that is configured to supply ink from the ink cartridge to the recording head, a subsidiary tank being provided in the ink supplying path, the subsidiary tank being configured to store ink supplied from the ink cartridge, wherein the ink discharging unit includes an ink forcibly supplying unit that is configured to forcibly supply ink from the subsidiary tank to the recording head, and wherein the control unit determines whether or not to drive the ink forcibly supplying unit based on the comparing result by the comparing unit.

11. A method for controlling a recording device, the recording device comprising: a recording head that is configured so as to eject ink therefrom; an ink cartridge that has an ink accommodating unit that is configured to accommodate ink therein; a mounting unit, in which the ink cartridge is mounted; a storing unit that is configured to store time length data indicative of a length of time to be taken by the ink cartridge to move from a first position to a second position different from the first position, the first position and the second position being defined within the mounting unit, the ink cartridge reaching the first position before reaching the second position when the ink cartridge is mounted in the mounting unit; a first detecting unit that is configured to output a first detection signal upon detecting that the ink cartridge is located at the first position; a second detecting unit that is configured to output a second detection signal upon detecting that the ink cartridge is located at the second position; and an ink discharging unit that is configured to forcibly eject ink from the recording head, the method comprising:

calculating a length of time taken by the ink cartridge to move from the first position to the second position based on the first detection signal and the second detection signal;

comparing the calculated length of time with the length of time indicated by the time length data; and controlling the ink discharging unit based on a comparing result by the comparing unit.

12. The method as claimed in claim 11, further comprising judging whether the time length data is read from the storing unit, and notifying an error when it is judged that the time length data is not read from the storing unit.

13. An ink cartridge, comprising:

a casing;

an ink accommodating unit that is provided in the casing;

a first moving body that is provided in the casing and that is movable relative to the casing;

a second moving body that is provided in the casing and that is movable relative to the casing;

a first detecting unit that is configured to detect that the first moving body is located at a first relative position relative to the casing;

a second detecting unit that is configured to detect that the second moving body is located at a second relative position relative to the casing; and a storing unit that is configured to store time length data indicative of a length of time defined from when the first moving body reaches the first relative position and until when the second moving body reaches the second relative position.

14. An ink cartridge, comprising:

an ink accommodating unit that is configured to accommodate ink therein;

an ink delivery path that is in fluid communication with the ink accommodating unit at one end and that has an ink delivery opening at another end;

a first valve that is provided in the another end of the ink delivery path and that is configured so as to be capable of being switched between an opened state and a closed state;

a second valve that is provided in the ink delivery path between the one end and the another end and that is configured so as to be capable of being switched between an opened state and a closed state;

a first detecting unit that is configured to detect whether the first valve is in the opened state or the closed state;

a second detecting unit that is configured to detect whether the first valve is in the opened state or the closed state; and a storing unit that is configured to store time length data indicative of a length of time defined from when the first valve is switched from the closed state to the opened state and until when the second valve is switched from the closed state to the opened state.

15. An ink cartridge, comprising:

an ink accommodating unit that is configured to accommodate ink therein; and a storing unit that is configured to store time length data indicative of a length of time to be taken by the ink cartridge to move for a predetermined distance.

16. The ink cartridge as claimed in claim 15, wherein the storing unit stores, in correspondence with the time length data, data indicative of whether or not it is necessary to perform an ink forcibly ejecting operation to forcibly eject ink from a recording head, to which ink is supplied from the ink accommodating unit.

17. The ink cartridge as claimed in claim 15, wherein the storing unit stores, in correspondence with the time length data, ink flowing amount data indicative of an amount of ink flowing out of the ink accommodating unit.

* * * * *